US012571184B2

(12) United States Patent
Young

(10) Patent No.: US 12,571,184 B2
(45) Date of Patent: Mar. 10, 2026

(54) SYSTEMS AND METHODS FOR CONTROL OF ELECTRICALLY POWERED POWER MACHINES

(71) Applicant: Doosan Bobcat North America, Inc., West Fargo, ND (US)

(72) Inventor: Christopher Young, Fargo, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 41 days.

(21) Appl. No.: 18/479,368

(22) Filed: Oct. 2, 2023

(65) Prior Publication Data

US 2024/0110366 A1 Apr. 4, 2024

Related U.S. Application Data

(60) Provisional application No. 63/412,759, filed on Oct. 3, 2022.

(51) Int. Cl.

| | |
|---|---|
| ***E02F 9/20*** | (2006.01) |
| ***E02F 3/34*** | (2006.01) |
| ***E02F 3/42*** | (2006.01) |
| ***E02F 3/43*** | (2006.01) |
| ***E02F 9/26*** | (2006.01) |

(52) U.S. Cl.

CPC ..... *E02F 9/2029* (2013.01); *E02F 3/3414* (2013.01); *E02F 3/422* (2013.01); *E02F 3/431* (2013.01); *E02F 9/2025* (2013.01); *E02F 9/207* (2013.01); *E02F 9/2095* (2013.01); *E02F 9/265* (2013.01)

(58) Field of Classification Search

CPC ..... E02F 3/3414; E02F 3/422; E02F 3/431; E02F 9/2025; E02F 9/2029; E02F 9/207; E02F 9/2095; E02F 9/265

See application file for complete search history.

(56) References Cited

U.S. PATENT DOCUMENTS 6,047,228 A * 4/2000 Stone ..... E02F 9/2025 701/50
6,061,617 A * 5/2000 Berger ..... E02F 3/438 701/34.2

(Continued)

FOREIGN PATENT DOCUMENTS

EP 2584101 A1 4/2013

OTHER PUBLICATIONS

International Searching Authority. International Search Report and Written Opinion for counterpart International PCT Application No. PCT/2023/075705, mailed Jan. 18, 2024 [10 pgs.].

*Primary Examiner* — Tyler J Lee

(74) *Attorney, Agent, or Firm* — Quarles & Brady LLP

(57) ABSTRACT

A control device for a power machine can be configured to receive operation data associated with a current operation of the electric power machine, determine, based on the operation data, a commanded direction of travel for the electric power machine, determine, based on the operation data, an orientation of the work element relative to the lift arm, perform a comparison of the orientation to an orientation criterion, and, in response to determining a forward commanded direction of travel and based on the comparison, determine a modified operation parameter for the electric power machine, and control the at least one of electrical actuators based on the modified operation parameter.

20 Claims, 13 Drawing Sheets

(56) References Cited

U.S. PATENT DOCUMENTS

| | | | | |
|---|---|---|---|---|
| 10,926,795 | B2 * | 2/2021 | Iwamura | B62D 11/06 |
| 12,071,743 | B2 * | 8/2024 | Kushner | E02F 3/844 |
| 12,180,672 | B2 * | 12/2024 | Durkin | B60K 1/00 |
| 2014/0271078 | A1 * | 9/2014 | Koch | E02F 9/265<br>414/815 |
| 2017/0022686 | A1 * | 1/2017 | Farmer | E02F 9/205 |
| 2019/0351910 | A1 * | 11/2019 | Kassen | B60W 10/12 |
| 2021/0123207 | A1 * | 4/2021 | Vandegrift | E02F 9/2012 |
| 2021/0270004 | A1 | 9/2021 | Durkin et al. | |
| 2021/0301494 | A1 * | 9/2021 | Berry | E02F 9/205 |
| 2022/0136203 | A1 * | 5/2022 | Kushner | E02F 3/7609<br>37/403 |
| 2022/0136204 | A1 * | 5/2022 | Kushner | E02F 3/422<br>37/403 |
| 2023/0109143 | A1 * | 4/2023 | Vollmar | E02F 9/0891<br>414/697 |
| 2023/0132898 | A1 * | 5/2023 | Rawlins | E02F 3/248<br>172/1 |

* cited by examiner

SYSTEMS AND METHODS FOR CONTROL OF ELECTRICALLY POWERED POWER MACHINES

CROSS-REFERENCE TO RELATED APPLICATIONS

This application claims priority to U.S. Provisional Application No. 63/412,759, filed Oct. 3, 2022, the entire contents of which is incorporated herein by reference.

BACKGROUND

This disclosure is directed toward power machines. More particularly, the present disclosure is directed to power machines that operate in whole or in part under electrical power. Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Conventional power machines can include hydraulic systems and related components that are configured to use output from a power source (e.g., an internal combustion engine) to perform different work functions. More specifically, hydraulic motors can be configured to power movement of a power machine, and hydraulic actuators (e.g., hydraulic cylinders) can be used to move a lift arm structure attached to the power machine, to tilt or otherwise move an implement connected to the lift arm structure, or execute other operations.

The discussion above is merely provided for general background information and is not intended to be used as an aid in determining the scope of the claimed subject matter.

SUMMARY OF THE DISCLOSURE

Some embodiments of the disclosure are directed to provided improvements systems and methods of protecting a tilt actuator of a power machine, and, more particularly, controlling operation parameters of one or more components of the power machine such that the tilt actuator of the power machine is protected from unnecessary strain and stresses. As one example situation, when a workgroup of a power machine is lifted and a tilt actuator is extended (e.g., rolled out), a cutting edge of a bucket may be positioned perpendicular to a ground surface. Following this example, the tilt actuator may experience damage when the cutting edge is pushed too hard. Accordingly, configurations described herein provide systems and methods for protecting the tilt actuator without unnecessarily impeding an operator from performing various operations with the power machine.

Some configurations described herein provide an electric power machine. The electric power machine may include a power machine frame. The electric power machine may include a plurality of electrical actuators supported by the power machine frame, wherein the plurality of electrical actuators includes a tractive motor, a lift actuator, and a tilt actuator. The electric power machine may include a lift arm structure. The lift arm structure may include a lift arm coupled to the power machine frame and configured to be moved relative to the power machine frame by the lift actuator; and a work element supported by the lift arm and configured to be moved relative to the lift arm by the tilt actuator. The electric power machine may include an electrical power source configured to power the plurality of electrical actuators. The electric power machine may include one or more electronic processors in communication with the plurality of electrical actuators. The one or more electronic processors may be configured to receive operation data for a current operation of the electric power machine. The one or more electronic processors may be configured to determine, based on the operation data, a commanded direction of travel for the electric power machine. The one or more electronic processors may be configured to determine, based on the operation data, an orientation of the work element relative to the lift arm. The one or more electronic processors may be configured to compare the orientation to an orientation criterion. The one or more electronic processors may be configured to, in response to determining the commanded direction of travel is for a first direction of travel and based on the comparison, determine a modified operation parameter for the electric power machine, and control the at least one of electrical actuators based on the modified operation parameter.

Some configurations described herein provide an electric power machine. The electronic power machine may include a power machine frame. The electronic power machine may include a plurality of electrical actuators supported by the power machine frame, wherein the plurality of electrical actuators includes a tractive motor, a lift actuator, and a tilt actuator. The electronic power machine may include a lift arm structure. The lift arm structure may include a lift arm coupled to the power machine frame and configured to be moved relative to the power machine frame by the lift actuator; and a work element supported by the lift arm and configured to be moved relative to the lift arm by the tilt actuator. The electronic power machine may include an electrical power source configured to power the plurality of electrical actuators. The electronic power machine may include one or more electronic processors in communication with the plurality of electrical actuators. The one or more electronic processors may be configured to receive operation data for a current operation of the electric power machine. The one or more electronic processors may be configured to determine, based on the operation data, a commanded direction of travel for the electric power machine. The one or more electronic processors may be configured to determine, based on the operation data, an orientation of the work element relative to the lift arm. The one or more electronic processors may be configured to perform a comparison of the orientation to an orientation criterion. The one or more electronic processors may be configured to, in response to determining the commanded direction of travel is for a first direction of travel and based on the comparison, determine an operational limit for the tractive motor, and control the tractive motor based on the operational limit.

Some configurations described herein provide a method of operating an electric power machine. The method may include receiving, with one or more electronic processors, input parameters corresponding to one or more of: an operator input for operating the electric power machine or sensed operation data for the electric power machine. The method may include determining, with the one or more electronic processors, a first direction of a commanded direction of travel for the electric power machine based on one or more of the input parameters. The method may include determining, with the one or more electronic processors, an orientation of a work element of the electric power machine based on one or more of the input parameters. The method may include perform a first comparison of the orientation to an orientation criterion. The method may include determining, with the one or more electronic processors, a lift position of a lift arm of the electric power machine. The method may include performing, with the one or more electronic processors, a second comparison of the lift position to a lift criterion. The method may include, for travel in the determined first direction, and based on the first and second comparisons: determining, with the one or more electronic processors, an operational limit for an electrical actuator of the electric power machine that includes a drive actuator or a lift actuator, and controlling, with the one or more electronic processors, the electrical actuator of the electric power machine based on the operational limit.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The following drawings are provided to help illustrate various features of examples of the disclosure and are not intended to limit the scope of the disclosure or exclude alternative implementations.

DETAILED DESCRIPTION OF THE PRESENT DISCLOSURE

Figure 1:
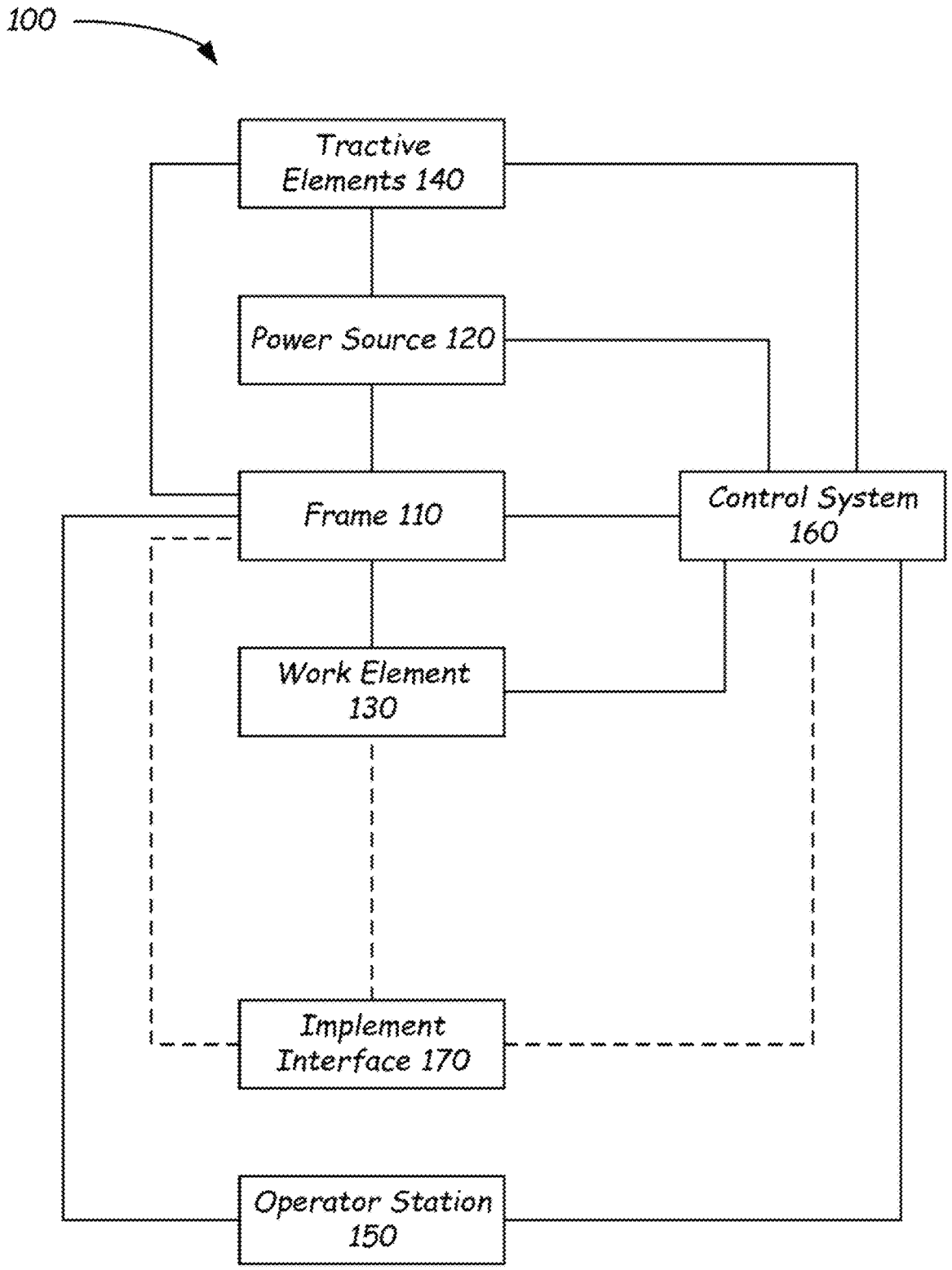
FIG. 1 is a block diagram illustrating functional systems of a representative power machine in accordance with some configurations.

The concepts disclosed in this discussion are described and illustrated by referring to exemplary configurations. These concepts, however, are not limited in their application to the details of construction and the arrangement of components in the illustrative configurations and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

As generally noted above, some actuators of a power machine can be subject to potentially damaging stresses during operation, particularly during certain operations that are powered by other actuators of a power machine. More specifically, in some cases, a tractive motor or a lift actuator can be commanded to provide tractive or lift power that could indirectly impose sufficient stresses to damage a tilt actuator. For example, when implemented with sufficient power, commanded travel of a power machine over terrain or a commanded lowering of a lift arm can sometimes cause an implement to be urged into the ground with sufficient force so as to damage a tilt actuator for the implement. It has been found that this problem can be particularly notable for electrically powered power machines, including because of the particularly large power and speed that may be provided by electrical lift and tractive actuators. Further, potential damage to tilt cylinders may be more likely under some combinations of lift, tilt, and tractive operational conditions (e.g., certain combinations of lift or tilt arm positions, and of commanded or actual travel speed or direction).

Correspondingly, for some examples of the disclosed technology, control systems of a power machine can be configured to implement modified operation of a power machine upon the detection by the control system of operational conditions that might otherwise result in unwanted stresses on a particular actuator. For example, upon detection of particular tractive operational conditions (e.g., a particular commanded tractive speed or power, or present travel speed), particular lift operational conditions (e.g., a lift arm height within a particular range), or a particular tilt operational conditions (e.g., a particular degree of extension of a tilt actuator), a control system can automatically implement a reduced speed limit or a reduced power limit on lift, tractive, or other actuators (i.e., reduced, as compared to a maximum, default, or another implemented limit implemented immediately beforehand). Thus, for example, upon detection of forward travel with a sufficiently high commanded speed, in combination with a particular tilt position of an implement (e.g., a relatively large tilt angle relative to a lift arm or ground, or a relatively large particular extension of a tilt actuator), a maximum power or speed of a lift actuator vary directly with lift position (e.g., decreasing with lift height or lift actuator extension). As another example, upon detection of forward travel with a sufficiently high commanded speed, in combination with a particular orientation of a lift actuator, a maximum torque limit or maximum speed limit of a tractive motor can vary indirectly with tilt position (e.g., decreasing with increasing tilt angle or tilt actuator extension).

In some implementations, other operational limits can be provided, including limitations on a load capacity of a lift actuator. For example, a control system can implement a maximum electric current limit for an electrical lift actuator that can correspond to a particular load rating (i.e., lift capacity) of a lift arm at particular lift positions (e.g., at particular extensions of the lift actuator, or particular vertical, horizontal, or other distances of particular points on the lift arm from reference features or locations). In some cases, different limits for maximum electric current can be implemented at different lift positions, including as can provide different load capacities at different lift positions. For example, a dynamic maximum electric current limit can correspond to a particular (e.g., constant) load rating over a middle range of lift positions, can correspond to an elevated load rating over a lower range of lift positions, or can correspond to a reduced load rating over a higher range of lift positions. In some cases, such an arrangement can allow for improved break-out capacity for power machines at low lift heights, while also preventing operations with excessive load or electric current at high lift heights.

As presented herein, a limit on the speed of a power machine or a component of a power machine can be implemented using various generally known control systems for electrical actuators. Further, those of skill in the art will recognize that an actuator speed limit in particular can be implemented based on an actual speed of an actuator (e.g., a speed of rotation, or of extension/retraction) or based on an actual speed of a component moved by the actuator (e.g., a travel speed of a power machine, or a speed of movement of a lift arm or other work element). Similarly, a speed or position of a power machine or component thereof can be determined using various generally known approaches, including measurement of an actual speed or position of an actuator, measurement of an actual speed or position of another work element (e.g., a lift arm or tiltable implement), or derivation of these values from other quantities, including as can be generally measured or derived from data provided by a linear or rotary encoder, a current sensor, a position sensor, etc.

Figure 2:
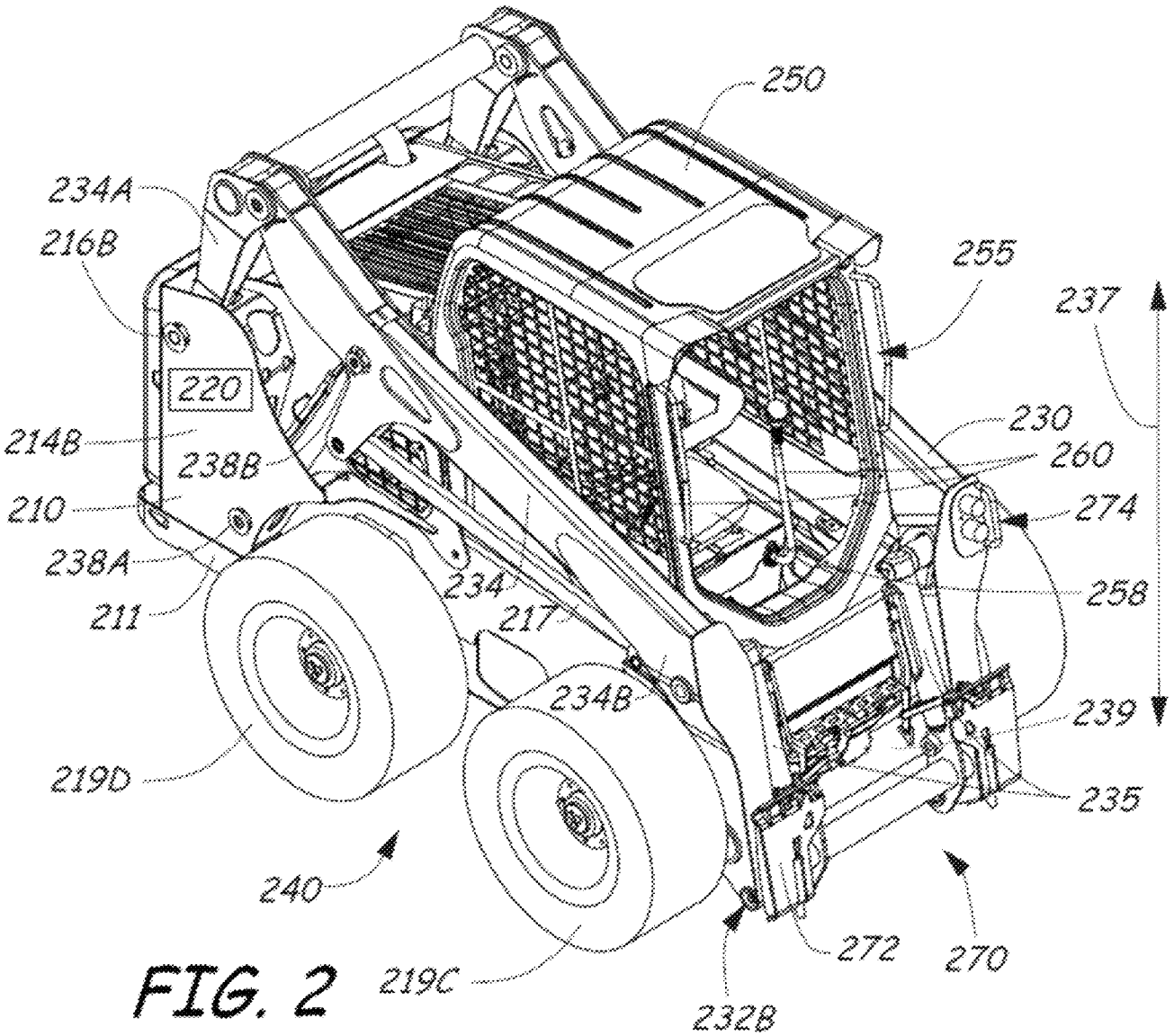
FIG. 2 is a perspective view showing generally a front of a power machine in accordance with some configurations.
Figure 3:
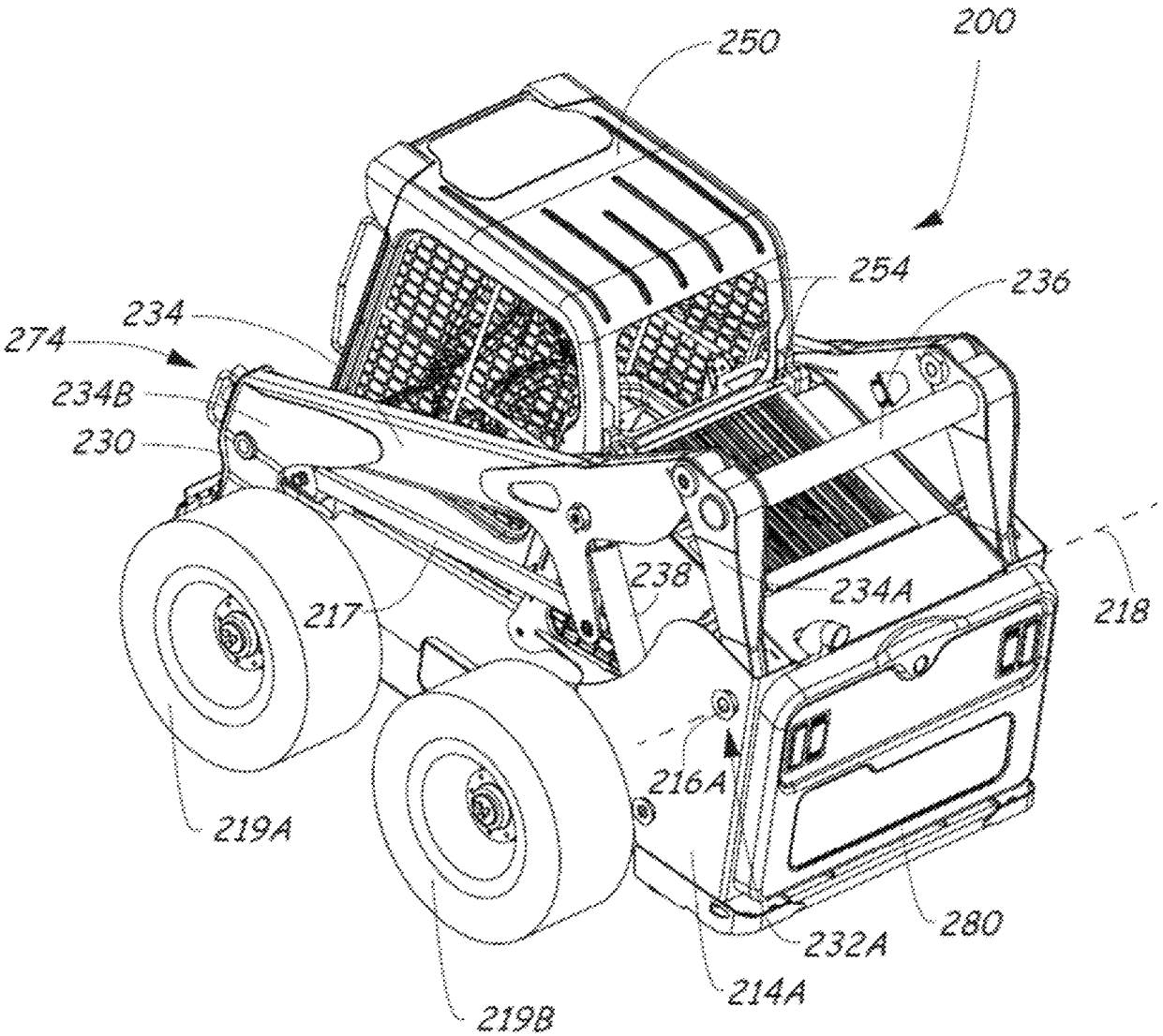
FIG. 3 is a perspective view showing generally a back of the power machine shown in FIG. 2 in accordance with some configurations.

These concepts can be practiced on various power machines, as will be described below. A representative power machine on which the configurations can be practiced is illustrated in diagram form in FIG. 1 and one example of such a power machine is illustrated in FIGS. 2-3 and described below before any configurations are disclosed. For the sake of brevity, only one power machine is illustrated and discussed as being a representative power machine. However, as mentioned above, the configurations below can be practiced on any of a number of power machines, including power machines of different types from the representative power machine illustrated in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, at least one work element, and a power source that can provide power to the at least one work element. At least one of the work elements is a motive system for moving the power machine under power.

FIG. 1 is a block diagram that illustrates the basic systems of a power machine 100, which can be any of a number of different types of power machines, upon which the configurations discussed herein can be advantageously incorporated. The block diagram of FIG. 1 identifies various systems on the power machine 100 and the relationship between various components and systems. As mentioned above, at the most basic level, power machines for the purposes of this discussion include a frame, a power source, and a work element. As illustrated in FIG. 1, the power machine 100 has a frame 110, a power source 120, and a work element 130. Because the power machine 100 illustrated in FIG. 1 is a self-propelled work vehicle, the power machine 100 also includes tractive elements 140, which are themselves work elements provided to move the power machine 100 over a support surface. The power machine 100 may also include an operator station 150. The operator station 150 may provide an operating position for controlling the work elements 130 of the power machine 100. A control system 160 is provided to interact with the other systems to perform various work tasks at least in part in response to control signals provided by an operator.

Certain work vehicles have work elements that can perform a dedicated task. As one example, some work vehicles have a lift arm to which an implement, such as a bucket, is attached, such as by a pinning arrangement. The work element, e.g., the lift arm or the implement, can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have a work element configured as an implement interface, such as an implement interface 170 as illustrated in FIG. 1. At its most basic, an implement interface 170 is a connection mechanism between the frame 110 or the work element 130 and an implement, which can be as simple as a connection point for attaching an implement directly to the frame 110 or the work element 130 or more complex, as discussed below.

On some power machines, the implement interface 170 can include an implement carrier. The implement carrier may be a physical structure movably attached to the work element 130. The implement carrier has engagement features and locking features to accept and secure any of a number of different implements to the work element 130. One characteristic of such an implement carrier is that once an implement is attached to the implement carrier, the implement carrier is fixed to the implement (e.g., not movable with respect to the implement) and when the implement carrier is moved with respect to the work element 130, the implement moves with the implement carrier. The term implement carrier as used herein is not merely a pivotal connection point, but rather a dedicated device specifically intended to accept and be secured to various different implements. The implement carrier itself is mountable to the work element 130, such as a lift arm or the frame 110. The implement interface 170 can also include one or more power sources for providing power to one or more work elements 130 on an implement. Some power machines can have a plurality of work elements with implement interfaces, each of which may, but need not, have an implement carrier for receiving implements. Some other power machines can have a work element 130 with a plurality of implement interfaces so that a single work element can accept a plurality of implements simultaneously. Each of these implement interfaces can, but need not, have an implement carrier.

The frame 110 includes a physical structure that can support various other components that are attached thereto or positioned thereon. The frame 110 can include any number of individual components. Some power machines have frames 110 that are rigid. That is, no part of the frame 110 is movable with respect to another part of the frame 110. Other power machines have at least one portion that can move with respect to another portion of the frame 110. As one example, excavators can have an upper frame portion that rotates with respect to a lower frame portion. Other work vehicles have articulated frames such that one portion of the frame 110 pivots with respect to another portion for accomplishing steering functions.

As illustrated in FIG. 1, the frame 110 supports the power source 120. The power source 120 is configured to provide power to one or more of the work elements 130, including the one or more tractive elements 140, as well as, in some instances, providing power for use by an attached implement via the implement interface 170. Power from the power source 120 can be provided directly to any of the work elements 130, the tractive elements 140, and the implement interfaces 170. Alternatively, or in addition, power from the power source 120 can be provided to the control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 illustrates a single work element designated as the work element 130, but various power machines can have any number of work elements. Work elements are typically attached to the frame 110 of the power machine 100 and movable with respect to the frame 110 when performing a work task. As one example, the power machine 100 can be a mower with a mower deck or other mower component as a work element 130, which may be movable with respect to the frame 110 of the mower. In addition, the tractive elements 140 are a special case of a work element 130 in that the work function of the tractive elements 140 is generally to move the power machine 100 over a support surface. The tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

The power machine 100 includes the operator station 150 that includes an operating position from which an operator can control operation of the power machine 100. In some power machines, the operator station 150 is defined by an enclosed or partially enclosed cab. Some power machines on which the disclosed configurations may be practiced may not have a cab or an operator compartment of the type described herein. As one example, a walk behind loader may not have a cab or an operator compartment, but rather an operating position that serves as the operator station 150 from which the power machine 100 is properly operated. More broadly, power machines other than work vehicles may have operator stations that are not necessarily similar to the operating positions and operator compartments referenced above. Further, some power machines, such as the power machine 100 and others, whether or not they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both of the power machine and any implement to which is it coupled) that is capable of controlling at least some of the operator-controlled functions on the power machine.

FIGS. 2-3 illustrate a loader 200, which is one particular example of a power machine of the type illustrated in FIG. 1 where the configurations discussed herein can be advantageously employed. The loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements. Correspondingly, although some example power machines discussed herein are presented as skid-steer power machines, some embodiments disclosed herein can be implemented on a variety of other power machines. For example, some embodiments can be implemented on compact loaders or compact excavators that do not accomplish turns via skidding.

The loader 200 is one particular example of the power machine 100 illustrated broadly in FIG. 1 and discussed herein. To that end, features of the loader 200 described herein include reference numbers that are generally similar to those used in FIG. 1. As one example, the loader 200 is described as having a frame 210, just as the power machine 100 has the frame 110. The skid-steer loader 200 is described herein to provide a reference for understanding one environment on which the configurations described herein related to track assemblies and mounting elements for mounting the track assemblies to a power machine may be practiced. The loader 200 should not be considered limiting especially as to the description of features that loader 200 may have described herein that are not essential to the disclosed configurations and, thus, may or may not be included in power machines other than the loader 200 upon which the configurations disclosed below may be advantageously practiced. Unless specifically noted otherwise, configurations disclosed herein can be practiced on a variety of power machines, with the loader 200 being only one of those power machines. As one example, some or all of the concepts discussed below can be practiced on many other types of work vehicles such as various other loaders, excavators, trenchers, and dozers, to name but a few examples.

The loader 200 includes the frame 210 that supports a power system 220. The power system 220 may be capable of generating or otherwise providing power for operating various functions on the loader 200. The power system 220 is illustrated in block diagram form but is located within the frame 210. The frame 210 also supports a work element in the form of a lift arm assembly 230 that is powered by the power system 220 and that can perform various work tasks. As the loader 200 is a work vehicle, the frame 210 also supports a traction system 240, which is also powered by the power system 220 and can propel the loader 200) over a support surface. The lift arm assembly 230 in turn supports an implement interface 270, which includes an implement carrier 272 that can receive and secure various implements to the loader 200 for performing various work tasks and power couplers 274, to which an implement can be coupled for selectively providing power to an implement that might be connected to the loader 200. The power couplers 274 can provide sources of hydraulic or electric power or both. The loader 200 includes a cab 250 that defines an operator station 255 from which an operator can manipulate various control devices 260 to cause the loader 200 to perform various work functions. The cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. The operator input devices can include buttons, switches, levers, sliders, pedals and the like. The operator input devices can be stand-alone devices, such as hand operated levers or foot pedals. Alternatively, or in addition, the operator input devices may be incorporated into hand grips or display panels, including programmable input devices. Actuation of the operator input devices can generate signals in the form of electrical signals, hydraulic signals, or mechanical signals. Signals generated in response to actuation of the operator input devices are provided to various components on the loader 200 for controlling various functions on the loader 200. Among the functions that are controlled via actuation of the operator input devices on the loader 200 include control of the tractive elements 219, the lift arm assembly 230, the implement carrier 272, and providing signals to any implement that may be operably coupled to the implement.

Loaders can include human-machine interfaces, including display devices that are provided in the cab 250 to give indications of information relatable to the operation of the power machines in a form that can be sensed by an operator, such as, for example, audible or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the loader 200 or an implement coupled to the loader 200. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include or interacting with the configurations discussed herein can have various different frame components that support various work elements. The elements of the frame 210 discussed herein are provided for illustrative purposes and the frame 210 is not the only type of frame that a power machine on which the configurations can be practiced can employ. The frame 210 of the loader 200 includes an undercarriage or a lower portion 211 of the frame 210 and a mainframe or an upper portion 212 of the frame 210 that is supported by the undercarriage 211. The mainframe 212 of the loader 200, in some configurations is attached to the undercarriage 211, such as with fasteners or by welding the undercarriage 211 to the mainframe 212. Alternatively, the mainframe 212 and the undercarriage 211 can be integrally formed. The mainframe 212 includes a pair of upright portions 214A and 214B located on either side and toward the rear of the mainframe 212. The pair of upright portions 214A and 214B may support a lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. The joints 216A and 216B are aligned along an axis 218 so that the lift arm assembly 230 is capable of pivoting, as discussed below, with respect to the frame 210 about the axis 218. Other power machines may not include upright portions 214A and 214B on either side of the frame 210 or may not have the lift arm assembly 230 that is mountable to upright portions 214A and 214B on either side and toward the rear of the frame 210. As one example, some power machines may have a single arm, mounted to a single side of the power machine 100 or to a front or rear end of the power machine 100. Other machines can have a plurality of work elements 130, including a plurality of lift arms, each of which is mounted to the power machine 100 in its own configuration. The frame 210 also supports a pair of tractive elements in the form of wheels 219A-D on either side of the loader 200.

The lift arm assembly 230 illustrated in FIGS. 2-3 is one example of many different types of lift arm assemblies that can be attached to a power machine, such as the loader 200 or other power machines on which configurations of the present discussion can be practiced. The lift arm assembly 230 is what is known as a vertical lift arm, meaning that the lift arm assembly 230 is moveable (e.g., the lift arm assembly 230 can be raised and lowered) under control of the loader 200 with respect to the frame 210 along a lift path 237 that forms a generally vertical path. Other lift arm assemblies can have different geometries and can be coupled to the frame 210 of the loader 200 in various ways to provide lift paths that differ from the radial path of lift arm assembly 230. As one example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the disclosed configurations or concepts set forth in this discussion are limited by the type or number of lift arm assemblies that are coupled to a particular power machine.

The lift arm assembly 230 has a pair of lift arms 234 that are disposed on opposing sides of the frame 210. A first end 232A of each of the lift arms 234 is pivotally coupled to the loader 200 at the joints 216 and a second end 232B of each of the lift arms 234 is positioned forward of the frame 210 when in a lowered position, as illustrated in FIG. 2. The joints 216 are located toward a rear of the loader 200 so that the lift arms 234 extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 that is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. The cross member 236 provides increased structural stability to the lift arm assembly 230. A pair of actuators 238, which on the loader 200 are hydraulic cylinders configured to receive pressurized fluid from the power system 220, are pivotally coupled to both the frame 210 and the lift arms 234 at the pivotable joints 238A and 238B, respectively, on either side of the loader 200. The actuators 238 are sometimes referred to individually and collectively as lift cylinders. Actuation (e.g., extension and retraction) of the actuators 238 cause the lift arm assembly 230 to pivot about the joints 216 and, thereby, be raised and lowered along a fixed path (illustrated by an arrow 237 in FIG. 2). Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e., along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 234. The implement interface 270 includes an implement carrier 272 that is capable of accepting and securing a variety of different implements to the lift arm 230. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. As one example, machines with implement carriers can provide an actuator between the implement carrier and the lift arm assembly, so that removing or attaching an implement does not involve removing or attaching an actuator from the implement or removing or attaching the implement from the lift arm assembly 230. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electrical actuators or an electronic controller on an implement. The implement power source 274 also exemplarily includes electrical conduits that are in communication with a data bus on the excavator 200 to allow communication between a controller on an implement and electronic devices on the loader 200.

The frame 210 supports and generally encloses the power system 220 so that the various components of the power system 220 are not visible in FIGS. 2-3. The arrangement of drive pumps, motors, and axles in the loader 200 is but one example of an arrangement of these components. As discussed above, the loader 200 is a skid-steer loader and thus tractive elements on each side of the power machine are controlled together via the output of a single hydraulic pump, either through a single drive motor as in the loader 200 or with individual drive motors. Various other configurations and combinations of hydraulic drive pumps and motors can be employed as may be advantageous.

The description of the power machine 100 and the loader 200 above is provided for illustrative purposes, to provide illustrative environments on which the configurations discussed herein can be practiced. While the configurations discussed can be practiced on a power machine, such as is generally described by the power machine 100 illustrated in the block diagram of FIG. 1, and, more particularly, on the loader 200, such as track loader, unless otherwise noted or recited, the concepts discussed herein are not intended to be limited in their application to the environments specifically described above.

Figure 4:
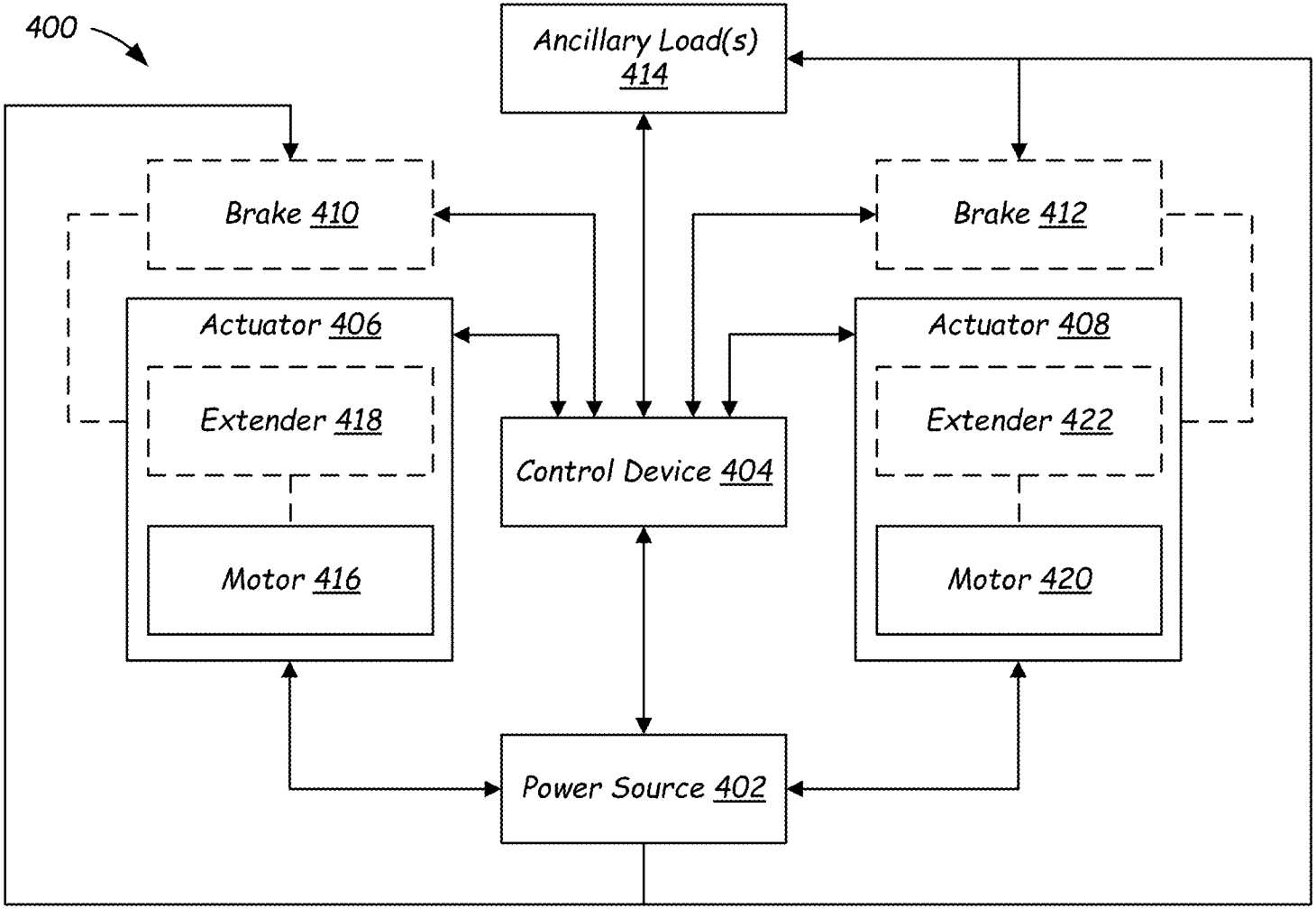
FIG. 4 is a block diagram schematic illustration of a power system of a power machine in accordance with some configurations.

FIG. 4 illustrates a schematic illustration of a block diagram of a power machine 400, which can be any of a number of different types of power machines (e.g., wheeled or tracked skid-steer loaders), including any of the types generally discussed above. The power machine 400 can include a power source 402, a control device 404, electrical actuators 406, 408, brakes 410, 412, and ancillary load(s) 414. The power machine 400 can be an electrically powered power machine and, thus, the power source 402 can include an electrical power source such as, for example, a battery pack that includes one or more battery cells (e.g., lithium-ion batteries). In some configurations, the power source 402 can include other electrical storage devices (e.g., a capacitor), and other power sources. Alternatively, or in addition, the power machine 400 can, but need not, include an internal combustion engine that provides, via a generator, electrically power to the power source 402 (e.g., to charge one or more batteries of the electrical power source).

Generally, the control device 404 can be implemented in a variety of different ways. For example, the control device 404 can be implemented as known types of processor devices, (e.g., microcontrollers, field-programmable gate arrays, programmable logic controllers, logic gates, etc.), including as part of general or special purpose computers. In addition, the control device 404 can also include other computing components, including memory, inputs, output devices, etc. (not shown). In this regard, the control device 404 can be configured to implement some or all of the operations of the processes described herein, which can, as appropriate, be retrieved from memory. In some embodiments, the control device 404 can include multiple control devices (or modules) that can be integrated into a single component or arranged as multiple separate components. In some embodiments, the control device 404 can be part of a larger control system (e.g., the control system 160 of FIG. 1) and can accordingly include or be in electronic communication with a variety of control modules, including hub controllers, engine controllers, drive controllers, and the like.

In different configurations, different types of actuators can be configured to operate under power from the power source 402, including electrical actuators configured as rotary actuators, linear actuators, and combinations thereof. As illustrated in FIG. 4, each electrical actuator 406, 408 can include a motor 416, 420 and an extender 418, 422. The actuators 406 and 408 schematically represent various actuators on the power machine 400. For the purposes of illustration, the electrical actuator 406 can be a linear actuator that includes the motor 416 and the extender 418, while the electrical actuator 408 can similarly include the motor 420 and the extender 422. Each motor 416, 420 can drive extension (and retraction) of the respective extender 418, 422 to implement a particular functionality for the power machine 400. For example, the motor 416, which can include a stator that rotates a rotor, can drive extension of the extender 418 when the motor 416 rotates in a first rotational direction, and can drive retraction of the extender 418 when the motor 416 rotates in a second rotational direction opposite the first rotational direction. In this way, and depending on how the electrical actuator 406 is coupled to the components of the power machine 400, extension (and retraction) of the electrical actuator 406 can, for example, raise (or lower) a lift arm of the power machine 400, change an attitude of an implement of the power machine 400 (e.g., a bucket), etc. The power machine 400 can also include rotary actuators without extenders (also represented in FIG. 4 by the actuators 406 and 408) that are configured to drive the power machine 400 over terrain.

As mentioned above, each extender 418, 422 can move in a straight line (e.g., to implement a functionality for the power machine 400), and thus each electrical actuator 406, 408 can be an electrical linear actuator. In this case, for example, each extender 418, 422 can include a lead screw, a ball screw, or other known components for rotationally powered linear movement.

While the electrical actuators 406, 408 are each illustrated in FIG. 4 as potentially including a respective extender 418, 422, in some embodiments, some electrical actuators can be implemented to lack an extender. In this case, each electrical actuator 406, 408 can include the respective motor 416, 420 to drive rotation of a particular component, rather than driving (linear) extension of a component (e.g., the extender). As one example, the electrical actuator 406 can be the tractive motor of a drive system of the power machine 400 to drive forward (and reverse) travel of the power machine 400. Although FIG. 4 illustrates two electrical actuators 406, 408, the power machine 400 can include other numbers of electrical actuators, such as, for example, one, two, three, four, five, six, etc. In some cases, the power machine 400 can include an electrical actuator that is a first lift actuator on a first lateral side of the power machine 400, an electrical actuator that is a second lift actuator on a second lateral side of the power machine 400, an electrical actuator that is a first tilt actuator that is on a first lateral side of the implement interface of the power machine 400, an electrical actuator that is a second tilt actuator that is on a second lateral side of the implement interface of the power machine 400, an electrical actuator that is a motor for a first drive system that is on (or otherwise powers) the first lateral side of the power machine 400, and an electrical actuator that is a motor for a second drive system that is on (or otherwise powers) the second lateral side of the power machine 400.

As also shown in FIG. 4, the brakes 410, 412 can be coupled to (e.g., included in) the respective electrical actuators 406, 408. For example, each brake 410, 412 can be a mechanical brake that includes a mechanical stop that can be moved into engagement to block further movement of the relevant extender 418, 422 (or, in some cases, the relevant motor 416, 420) in one or more directions, and can be moved into disengagement to allow movement of the extenders 418, 422 (e.g., to move in the extension or retraction directions). In some cases, a mechanical brake can include an arm that contacts the lead screw of the extender 418, 422 (if a particular actuator has an extender) to block further movement of the extender 418, 422, and that disengages with the lead screw of the extender 418, 422 to allow (further) movement of the extender 418, 422. In some embodiments, one or more of the mechanical brakes 410, 412 can be an electrically powered brake (i.e., can include one or more electrical actuators). For actuators, such as a drive motor, that do not have an extender, a brake can engage any acceptable moving mechanism to selectively prevent movement of the motor.

As illustrated in FIG. 4, the power source 402 can be electrically connected to the control device 404, the electrical actuators 406, 408, the mechanical brakes 410, 412, and the ancillary load(s) 414. Thus, the power source 402 can provide power to each motor 416, 420 to drive movement (e.g., extension and retraction) of the respective extenders 418, 422, to the control device 404, to each mechanical brake 410, 412, to each of the ancillary load(s) 414, etc. As illustrated in FIG. 4, the control device 404 can be in electrical communication with the power source 402, the actuators 406, 408, the mechanical brakes 410, 412, and the ancillary load(s) 414, and can adjust (e.g., limit) the power delivered to or consumed by each of these electrical loads (or others). As one example, as appropriate, the control device 404 can adjust (e.g., decrease) the power delivered to each of these electrical loads by adjusting (e.g., decreasing) the current that can be consumed by at least some of these electrical loads. In some cases, an actual command for movement of an actuator can be scaled downward from a commanded movement of the actuator according to an operator input, so that the actuator will consume less power than commanded by the operator input. As one example, an operator may command a particular travel speed for a power machine and the actual commanded speed for the relevant drive motor(s) by the control device 404 may be comparatively reduced (e.g., based on a predetermined derating of the motor(s)). As another example, the control device 404 can adjust the current delivered to an electrical load by adjusting a driving signal delivered to a current source (e.g., a voltage controlled current source) that can be electrically connected to the electrical load (e.g., integrated within a power electronics driver board, such as a motor driver) to deliver current to the electrical load. As one example, the current source can include one or more field-effect transistors, and the driving signal can be the voltage applied to the one or more field-effect transistors to adjust the current delivered and thus the power delivered to the electrical load (e.g., the motor).

In some configurations, similarly to each of the electrical loads of the power machine 400, the electrical power source of the power source 402 can include (or can be otherwise electrically connected to) a current source (e.g., a power electronics board) that adjusts (e.g., and can restrict) the amount of power to be delivered to the electrical loads of the power machine 400. In this case, the control device 404 can adjust the driving signal to the electrical power source to adjust the total amount of current and thus the amount of power delivered to the electrical loads of the power machine 400. More particularly, the control device 404 can adjust the output from the electrical power source to regulate the torque, position, direction, and speed of the motor.

As also noted above, in some configurations, the power machine 400 can include one or more ancillary loads 414 (e.g., loads not associated with providing tractive or workgroup power). As one example, the ancillary loads 414 can each be an electrical load that receives power from the electrical power source of the power source 402. For example, an ancillary load 414 can include a climate control system (e.g., including a heater, an air-conditioning system, a fan, etc.), a sound system (e.g., a speaker, a radio, etc.), etc.

In some configurations, the power machine 400 can include one or more sensors that can sense various aspects of the power machine 400. As one example, the power machine 400 can include a torque sensor for each electrical actuator to sense a current torque of each motor of the respective electrical actuator. In some cases, the torque sensor can be the same as the current sensor electrically connected to the electrical actuator (e.g., because current is related to the torque). As another example, the power machine 400 can include a position sensor for each extender of each electrical actuator (as appropriate) to sense a present or current extension amount for the extender of each electrical actuator (e.g., relative to the housing of the electrical actuator). In some cases, this can be a hall-effect sensor, a rotary encoder for the motor (e.g., which can be used to determine the extension amount of actuators with extenders), an optical sensor, etc. As yet another example, the power machine 400 can include an angle sensor for each pivotable joint of the lift arm of the power machine 400 to determine a current orientation of the lift arm (and implement coupled thereto). As yet another example, the power machine 400 can include a speed sensor or an acceleration sensor (e.g., an accelerometer) to respectively determine a current speed or a current acceleration of the power machine 400 (or a component thereof). As still yet another example, the power machine 400 can include an inclinometer (e.g., an accelerometer) that can sense the current attitude of a mainframe of the power machine 400 with respect to gravity.

Figure 5:
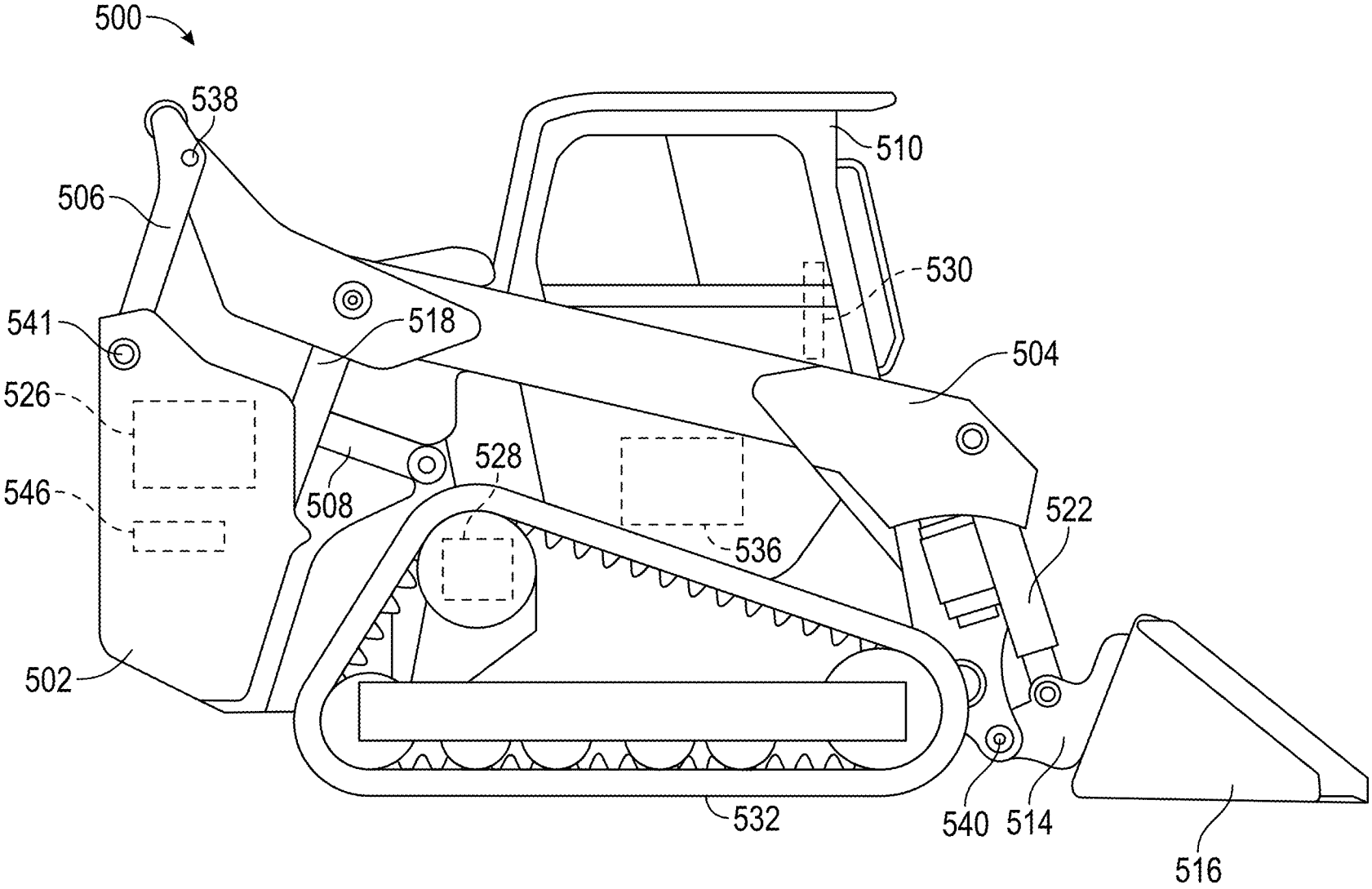
FIG. 5 is a side isometric view of an electrically powered power machine with the lift arm in a fully lowered position in accordance with some configurations.

FIG. 5 shows a side isometric view of an electrically powered power machine 500 with a lift arm 504 in a fully lowered position, which can be a specific implementation of the power machine 200, the power machine 400, etc. As illustrated in FIG. 5, the power machine 500 can include a main frame 502, the lift arm 504 coupled to the main frame via a follower link 506, a driver link 508 pivotally coupled to the lift arm 504 and the main frame 502, an operator enclosure 510 (e.g., a cab, as shown), an implement interface 514 coupled to an end of the lift arm 504, an implement 516 (e.g., a bucket as shown) coupled to the implement interface 514, an electrical lift actuator 518, an electrical tilt actuators 522, an electrical power source 526, a drive system 528 (e.g., including an electrical drive motor), a traction devices 532 (e.g., an endless track, as shown), and a climate control system 536 (e.g., as generally representative of an ancillary electrical load). An operator input device 530 can be provided in the cab 510, including as can be implemented as a touchscreen, electronic joystick, or other known input device. As generally noted above, similar other components can be provided symmetrically (or otherwise) on an opposing lateral side of the power machine 500, including another electrical lift actuator, another electrical tilt actuator, etc.

In some cases, the electrical power source 526 can be implemented in a similar manner as the previously described power sources (e.g., the power source 402). Thus, the electrical power source 526 can include a battery pack including one or more batteries. In general, the electrical power source 526 can supply power to some or all of the electrical loads of the power machine 500. For example, the electrical power source 526 can provide power to the lift electrical actuator 518, the electrical tilt actuator 522, the drive system 528, the climate control system 536, etc.

The power machine 500 can also include a control device 546 that can be in communication with the power source 526 and some (or all) of the electrical loads of the power machine 500, as appropriate. For example, the control device 546 can be in communication with the lift electrical actuator 518, the workgroup electrical actuator 522, the drive system 528, the climate control system 536, etc. In this way, the control device 546 can control operation of these components, or related other systems, to adjust how power is routed to each of these electrical loads (e.g., depending on the criteria defined by the particular power management mode) and, correspondingly, how much power from the power source 526 is consumed during a given operational interval.

Figure 6:
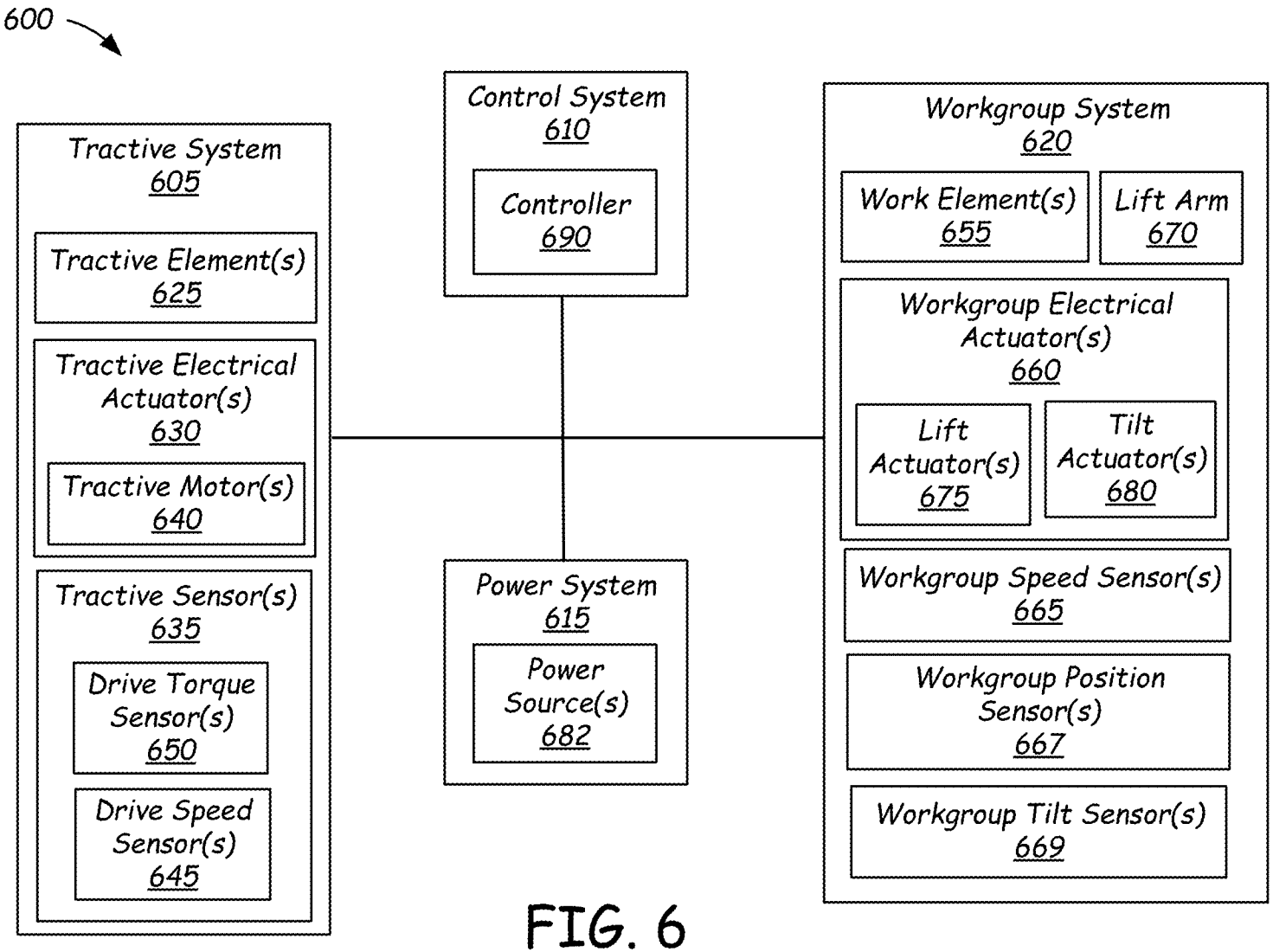
FIG. 6 schematically illustrates an example power machine according to some configurations.

FIG. 6 schematically illustrates a power machine 600 according to some configurations. In the example illustrated in FIG. 6, the power machine 600 includes a tractive or drive) system 605, a control system 610 (e.g., the control system 160, as described above), a power system 615, and a workgroup system 620. The tractive system 605, the control system 610, the power system 615, and the workgroup system 620 communicate over one or more communication lines or buses. The power machine 600 may include additional, fewer, or different components than those illustrated in FIG. 6 in various configurations and may perform additional functionality than the functionality described herein. For example, the power machine 600 may include additional, similar, or different components, systems, and functionality as described above with respect to the power machine 100 of FIG. 1, the loader 200 of FIGS. 2-3, the power machine 400 of FIG. 4, the electric power machine 500 of FIG. 5, or another power machine described herein.

As illustrated in FIG. 6, the power machine 600 includes the tractive system 605 (e.g., the tractive system 240 of FIG. 2), which is configured to propel the power machine 600 over terrain or, more generally, a support surface. In the illustrated example, the tractive system 605 includes one or more tractive elements 625 (for example, the tractive elements 140 of FIG. 1), one or more tractive electrical actuators 630 (for example, the actuator 406, 408 of FIG. 4), and one or more tractive sensors 635. The tractive system 605 may include additional, fewer, or different components than those illustrated in FIG. 6 in various configurations and may perform additional functionality than the functionality described herein.

The one or more tractive elements 625 may be referred to herein collectively as "the tractive elements 625" or individually as "the tractive element 625." As described above, with respect to FIG. 1, the tractive elements 625 may be work elements themselves that are provided to move the power machine 600 over a support surface. The tractive elements 625 can be, e.g., track assemblies, wheels attached to an axle, and the like. The tractive elements 625 can be mounted to a power machine frame of the power machine 600 (e.g., the frame 110, as described above) such that movement of the tractive elements 625 is limited to rotation about an axle (so that steering is accomplished by a skidding action) or, alternatively, pivotally mounted to the power machine frame to accomplish steering by pivoting the tractive element with respect to the frame.

In some configurations, each tractive element 625 may be driven (or controlled) by a corresponding tractive electrical actuator (e.g., the tractive electrical actuator 630). In the illustrated example, the tractive electrical actuator(s) 630 of the tractive system 605 may include one or more tractive motors 640 (e.g., drive motors).

In the illustrated example, the tractive sensors 635 may include a drive speed sensor 645 and a drive torque sensor 650. The drive speed sensor 645 may collect (e.g., detect) speed data for the power machine 600 (or a component thereof). In some configurations, the drive speed sensor 645 may be an acceleration sensor (e.g., an accelerometer). The drive speed sensor 645 may determine a current speed or current acceleration of the power machine 600 (or a component thereof). The drive torque sensor 650 may collect (e.g., detect) torque data for the power machine 600 (or a component thereof). In some configurations, the tractive system 605 may include a drive torque sensor 650 for each tractive electrical actuator 630 to sense a current torque of each tractive motor 640 of the respective tractive electrical actuator 630. In some cases, the drive torque sensor 650 can be the same as an electric current sensor electrically connected to the tractive electrical actuator 630 (e.g., because electric current is related to the torque). Each of these measured values (or others) can inform a present operational condition of the power machine 600, which can be used by the control system 610, as described in greater detail herein.

The power machine 600 also may include the workgroup system 620 (also referred to herein as a lift arm structure). In the illustrated example, the workgroup system 620 may include one or more work elements 655 (e.g., the work element 130 of FIG. 1 or the bucket 516 of FIG. 5), one or more workgroup electrical actuators 660, one or more workgroup speed sensors 665, one or more workgroup position sensors 667 (e.g., including one or more workgroup tilt sensors 669), and a lift arm 670 (e.g., the lift arm assembly 230 or a component thereof, as described herein).

In the illustrated example, the workgroup electrical actuators 660 of the workgroup system 620 includes a lift actuator 675 and a tilt actuator 680 (e.g., an electrical lift actuator and an electrical tilt actuator, respectively). Generally, lift and tilt actuators corresponding to the lift actuator 675 and the tilt actuator 680 are described in greater detail herein with respect to FIGS. 1-5. Correspondingly, the workgroup speed sensors 665 can be arranged to measure a speed of movement (e.g., rotation or extension) of the lift actuator 675 or the tilt actuator 680. Similarly, the workgroup position sensors 667 can be configured to measure a linear extension or angular orientation of an actuator or other component of a workgroup, with the workgroup tilt sensor 669 in particular arranged to measure a degree of tilt between the work element 655 and the lift arm 670 (although other tilt measurements are possible).

The workgroup speed sensor(s) 665 may function similar to the drive speed sensor 645. In some configurations, the workgroup speed sensor 665 may collect (e.g., detect) speed data for the power machine 600 (or a component thereof). In some configurations, the workgroup speed sensor 665 may be an acceleration sensor (e.g., an accelerometer). The workgroup speed sensor 665 may determine a current speed or current acceleration of the power machine 600 (or a component thereof). As one example, the workgroup speed sensor 665 may detect a lift speed associated with the lift actuator 675 (e.g., a speed associated with a change in height of the lift arm 670 or the work element 655 of the power machine 600).

The workgroup position sensor(s) 667 may collect position data for the power machine 600 (or a component thereof). As one example, the workgroup position sensor 667 may be associated with one of the workgroup electrical actuators 660, and may detect position data for the associated workgroup electrical actuator 660. As another example, the workgroup position sensors 667 may be associated with each extender of each workgroup electrical actuator 660. Accordingly, in some configurations, the workgroup position sensors 667 may sense a current extension amount (as position data) for the extender of each workgroup electrical actuator 660 (e.g., relative to a housing of the workgroup electrical actuator 660). In some cases, the workgroup position sensor 667 may be a hall-effect sensor, a rotary encoder for the motor (e.g., which can be used to determine the extension amount of actuators with extenders), an optical sensor, etc. Accordingly, in some configurations, position data may include a lift height of the lift arm 670 or the work element 655, an extension amount associated with the lift actuator 675, or the like.

The workgroup tilt sensor(s) 669 may collect tilt or orientation data for the power machine 600 (or a component thereof). In some configurations, the workgroup tilt sensor 669 may be an angle sensor for each pivotable join of the lift arm 670 of the power machine 600 to determine a current orientation of the lift arm 670 (or the work element(s) 655 coupled thereto).

The power machine 600 may also include a power system 615 (e.g., the power system 120 of FIG. 1, the power system 220 of FIG. 2, etc.). In the illustrated example of FIG. 6, the power system 615 may include one or more power sources 682. As described herein, the power system 615 (via one or more of the power sources 682) may generate or otherwise provide electrical power for operating various functions on the power machine 600 (or components thereof). Accordingly, the power system 615 may provide electrical power to various components of the power machine 600, such as, e.g., one or more components of the tractive system 605, control system 610, the workgroup system 620, or the like. Accordingly, the power machine 400 can be an electrically powered power machine and, thus, the power system 615 can include an electrical power sources 682, such as, e.g., a battery pack that includes one or more battery cells (e.g., lithium-ion batteries). In some configurations, the power system 615 can include other electrical storage devices (e.g., a capacitor), and other power sources. Alternatively, or in addition, the power machine 600 can, but need not, include an internal combustion engine that provides, via a generator, electrically power to the power sources 682 (e.g., to charge one or more batteries of the electrical power system 615).

The power machine 600 may also include the control system 610. The control system 610 (e.g., the control system 160 of FIG. 1) is configured to receive operator input or other input signals (e.g., sensor data, such as speed data, position data, tilt or orientation data, or a combination thereof) and to output commands accordingly to control operation of the power machine 600. For example, the control system 610 can communicate with other systems of the power machine 405 to perform various work tasks, including to control the tractive electrical actuator(s) 630, the workgroup electrical actuator(s) 66, or a combination thereof for performing a tractive operation (e.g., travel across a support surface), a work task operation (e.g., a digging operation etc.), another operation of the power machine 600, or a combination thereof. In some configurations, the control system 610 receives input from an operator input device, such as one of the operator input devices 262 of FIG. 2, including input as command signals provided by an operator of the power machine 405 via the operator input device. As one example, a command signal may include a commanded speed for the power machine 600 (e.g., a speed at which the operator of the power machine 600 requests or commands). In response to receiving the input, the control system 610 may control the power machine 600 to perform an operation or maneuver based at least in part on the input received from the operator input device, the sensed operation data, or a combination thereof. Accordingly, in some configurations, the control system 610 may receive an input parameter corresponding to an operator input associated with operating the power machine 600, sensed operation data associated with the power machine 600, or a combination thereof.

Figure 7:
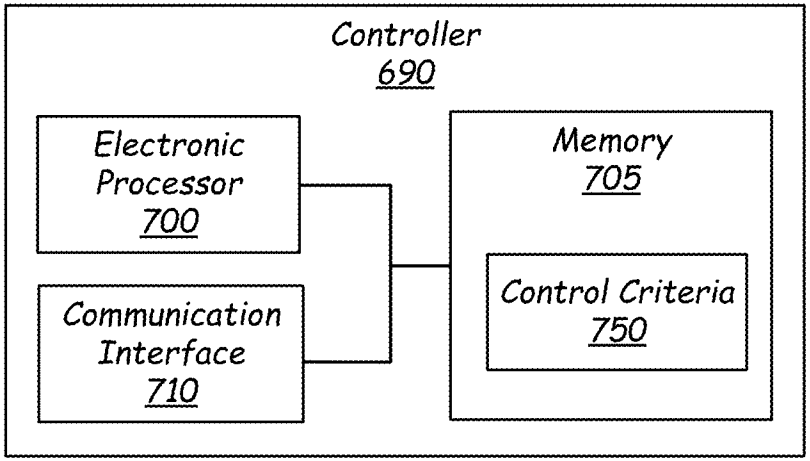
FIG. 7 schematically illustrates a controller of the power machine of FIG. 6 according to some configurations.

As illustrated in FIG. 6, the control system 610 includes a controller 690 (e.g., the control device(s) 260, 404 as described herein). FIG. 7 illustrates the controller 690 according to some configurations. In the illustrated example of FIG. 7, the controller 690 includes an electronic processor 700 (for example, a microprocessor, an application-specific integrated circuit ("ASIC"), or another suitable electronic device), a memory 705 (for example, a non-transitory, computer-readable medium), and a communication interface 710. The electronic processor 700, the memory 705, and the communication interface 710 communicate over one or more communication lines or buses. The controller 690 may include additional components than those illustrated in FIG. 7 in various configurations and may perform additional functionality than the functionality described herein. As one example, in some embodiments, the functionality described herein as being performed by the controller 690 may be distributed among other components or devices.

The communication interface 710 allows the controller 690 to communicate with devices external to the controller 690. For example, as illustrated in FIG. 6, the controller 690 may communicate with the tractive system 605 (or component(s) therein), the workgroup system 620 (or component (s) therein), other components or systems of the power machine 600, or a combination thereof through the communication interface 710.

The communication interface 710 may include a port for receiving a wired connection to an external device (for example, a universal serial bus ("USB") cabled and the like), a transceiver for establishing a wireless connection to an external device (for example, over one or more communication networks, such as the Internet, local area network ("LAN"), a wide area network ("WAN"), and the like), or a combination thereof. In some configurations, the controller 690 can be a dedicated or stand-alone controller. In some configurations, the controller 690 can be part of a system of multiple distinct controllers (e.g., a hub controller, a drive controller, a workgroup controller, etc.) or can be formed by a system of multiple distinct controllers (e.g., also with hub, drive, and workgroup controllers, etc.).

The electronic processor 700 is configured to access and execute computer-readable instructions ("software") stored in the memory 705. The software may include firmware, one or more applications, program data, filters, rules, one or more program modules, and other executable instructions. For example, the software may include instructions and associated data for performing a set of functions, including the methods described herein.

For example, as illustrated in FIG. 7, the memory 705 may store one or more control criteria 750 (referred to herein collectively as "the control criteria 750" and individually as "the control criterion 750"). Alternatively, or in addition, in some configurations, the control criteria 750 may be stored remotely, such as, for example, in a memory of a user device, or another remote device or database, such that each control criterion 750 is accessible by the controller 690.

The control criterion 750 may be a preset or predetermined operation parameter limit (or threshold). For example, in some configurations, the control criterion 750 may be a maximum operation parameter, a minimum operation parameter, or the like. Alternatively, or in addition, the control criterion 750 may be a preset or predetermined operation parameter range defined by an upper limit and a lower limit. In some configurations, the control criterion 750 may be a set of preset conditions, where each preset condition functions as a trigger for a corresponding operation parameter limit or range. In some configurations, the control criterion 750 is associated with an operation parameter, such as, e.g., a speed, a current, a torque, an orientation, a position, etc.). Alternatively, or in addition, in some configurations, the control criterion 750 is associated with multiple operation parameters. As one example, the control criterion 750 may set a speed limit (e.g., a maximum speed) for one of the tractive motor 640, the lift actuator 675, the tilt actuator 680, or another component of the power machine 600. In some configurations, the control criterion 750 may be an orientation criterion (or a tilt criterion), a commanded speed criterion, a position criterion (e.g., a lift position criterion), an actual speed criterion, a break-out condition criterion, etc.

Figure 8:
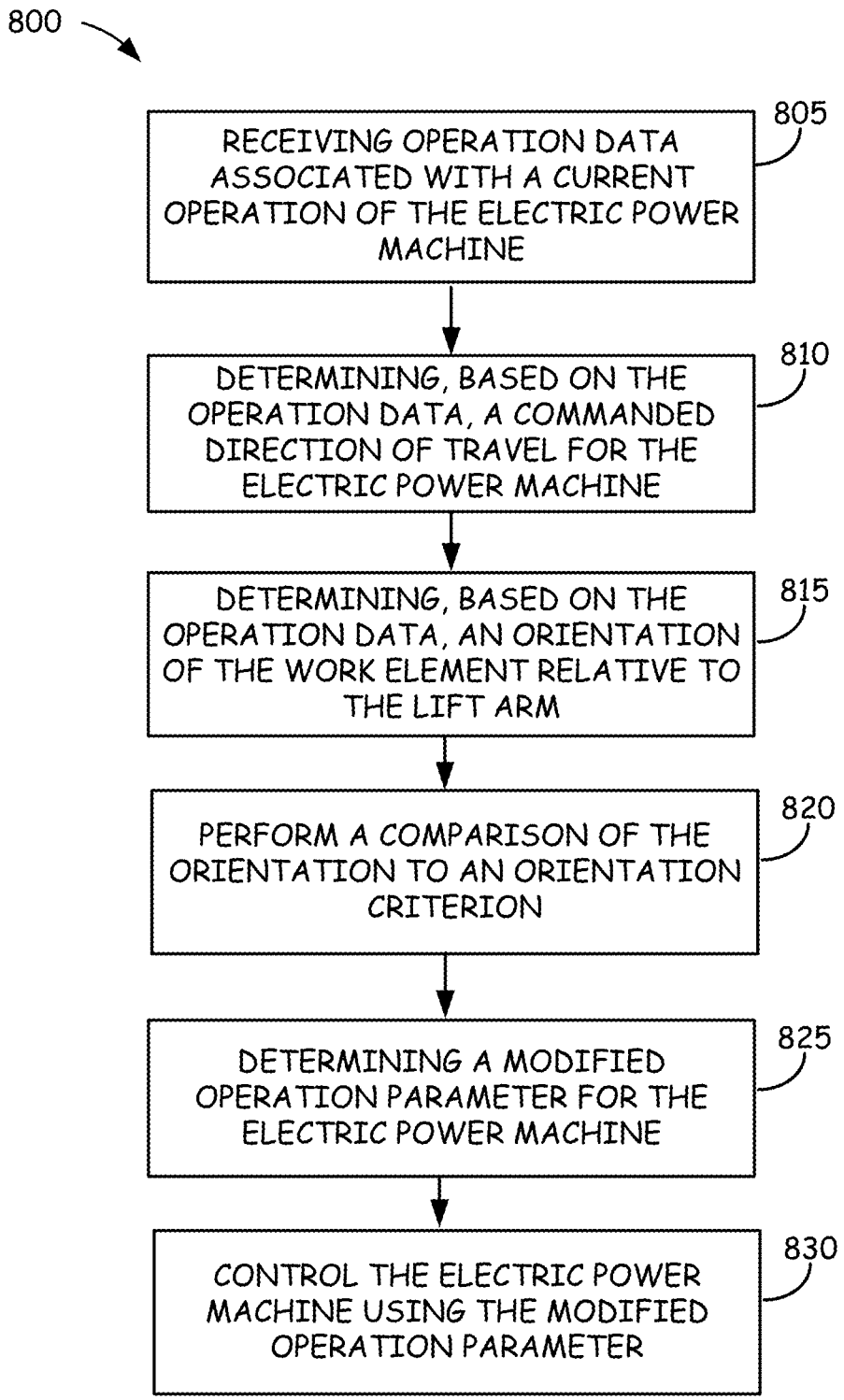
FIG. 8 is a flowchart illustrating a method of operating a power machine according to some configurations.

FIG. 8 is a flowchart illustrating a method 800 for operating a power machine (for example, the power machine 600) according to some configurations. In some configurations, the method 800 can be performed by the control system 610 (e.g., the controller 690) and, in particular, by the electronic processor 700 of the controller 690. However, as noted above, the functionality described with respect to the method 800 may be performed by other devices or can be distributed among a plurality of devices or components.

As illustrated in FIG. 8, the method 800 includes receiving, with the electronic processor 700, operation data associated with a current operation of the power machine 600 (at block 805). The operation data may include a lift actuator position (e.g., a position associated with the lift actuator 675), a lift actuator speed (e.g., a speed associated with the lift actuator 675), a drive torque (e.g., a torque associated with the tractive motor 640), a tilt actuator position (e.g., an orientation or position associated with the tilt actuator 680), a drive speed (e.g., a speed associated with the tractive motor 640), a commanded speed (e.g., a speed associated with an operator command), and the like. In some configurations, the operation data includes data collected or sensed by one or more sensors associated with the power machine 600 (as sensed operation data). For example, the operation data may be data collected by the drive torque sensor(s) 650, the drive speed sensor(s) 645, the workgroup speed sensor(s) 665, the workgroup position sensor(s) 667, the workgroup tilt sensor(s) 669, or another sensor of the power machine 600. Alternatively, or in addition, in some configurations, the operation data may include an operator input provided via an operator input device.

The electronic processor 700 may determine, based on the operation data, a commanded direction of travel for the power machine 600 (at block 810). In some configurations, the electronic processor 700 may determine the commanded direction of travel for the power machine 600 by detecting a commanded speed. The commanded speed may be a speed for the power machine 600 requested (or commanded) by an operator of the power machine 600 via, e.g., an operator input device. The electronic processor 700 may compare the commanded speed to a commanded speed criterion (e.g., as one of the control criteria 750). The commanded speed criterion may define that a positive speed value is associated with a forward commanded speed (e.g., a forward direction of travel) and that a negative speed value is associated with a negative commanded speed (e.g., a reverse direction of travel). Alternatively, or in addition, in some configurations, the commanded speed criterion may define a speed threshold or set point. The speed threshold or set point may be associated with a minimum commanded speed for the commanded speed to be considered an actual commanded speed as opposed to an unintended commanded speed (e.g., a vibration of the operator input device due to operation or vibrations of the power machine 600).

Accordingly, the electronic processor 700 may determine whether the commanded speed is a positive speed value or a negative speed value, whether the commanded speed satisfies the minimum commanded speed, or a combination thereof. As an example, the electronic processor 700 may determine that the commanded direction of travel for the power machine 600 is a forward commanded direction of travel when the commanded speed is a positive speed value and satisfies a preset speed value (e.g., a minimum commanded speed). As another example, the electronic processor 700 may determine that the commanded direction of travel for the power machine 600 is a reverse commanded direction of travel when the commanded speed is a negative speed value and exceeds the preset speed value. As yet another example, the electronic processor 700 may determine that the commanded direction of travel for the power machine 600 is an unintended commanded direction of travel, such as, e.g., when the commanded speed does not exceed (e.g., is less than or equal to) the preset speed value (e.g., 2.0% of a maximum command from an operator input device).

In some configurations, the electronic processor 700 may determine, based on the operation data, a lift position associated with the lift actuator 675. The electronic processor 700 may determine the lift position based on sensed operation data (e.g., data received from the workgroup position sensor 667). Alternatively, or in addition, the electronic processor 700 may determine the lift position based on operator input (e.g., via an operator input device).

The electronic processor 700 may determine, based on the operation data, an orientation of the work element 130 relative to the lift arm 670 (at block 815) or otherwise. An orientation may refer to a tilt of the work element 130 relative to the lift arm 670. The electronic processor 700 may determine the orientation of the work element 130 based on orientation or tilt data collected by the workgroup tilt sensor(s) 669. Alternatively, or in addition, the electronic processor 700 may determine the orientation of the work element 130 based on commanded tilt for the work element 130 (e.g., an operator input provided via an operator input device of the power machine 600).

The electronic processor 700 may perform a comparison of the orientation to an orientation criterion (at block 820). In some configurations, the orientation criterion may be included as one of the control criteria 750. The orientation criterion may define a tilt position value for the work element 130, including relative to the lift arm 670. In some configurations, the orientation criterion may be a preset or predetermined tilt position (e.g., within a specific range). The preset tilt position may represent a tilt position in which the tilt actuator 680 is extended to a position such that outside loads imposed on the tilt actuator 680 may impose relatively large stress or strain on the tilt actuator 680. As one example, the preset tilt position may be about 9.5 inches (or, e.g., 45 degrees of tilt relative to the lift arm). As another example, a preset tilt range may be about 9.5 inches to about 13.5 inches (or, e.g., 45 degrees of tile to 90 degrees of tilt relative to the lift arm).

In some configurations, the electronic processor 700 may determine that the orientation satisfies the orientation criterion when the orientation exceeds the preset tilt position. As one example, when the orientation is 10.5 inches of extension and the orientation criterion defines an extension threshold of 9.5 inches, the electronic processor 700 may determine that the orientation satisfies the orientation criterion because 10.5 inches is greater than 9.5 inches. Alternatively, or in addition, the electronic processor 700 may determine that the orientation satisfies the orientation criterion when the orientation falls within an orientation range defined by the orientation criterion.

In some configurations, the orientation criterion may be a preset or predetermined lift position (e.g., within a specific range). The preset lift position may represent a lift position in which the lift actuator 675 is extended to a position that may be likely to result in the imposition of relatively large stress or strain on the tilt actuator 680. As one example, the preset lift position may be about 11.0 inches (or, e.g., about 45% of a maximum extension of the lift actuator 675). As another example, a preset lift range may be about 11.0 inches to about 8.5 inches (or, e.g., between about 45% and about 30% of maximum lift actuator extension).

The electronic processor 700 may determine a modified operation parameter for the power machine 600 (at block 825). The modified operation parameter may include a modified electric current parameter, a modified speed parameter (e.g., a modified drive speed parameter, a modified lift speed parameter, etc.), a modified torque parameter, etc. In some configurations, the modified operation parameter may be an operation parameter limit (also referred to herein as an operational limit), such as, e.g., an electric current limit, a speed limit (e.g., a drive speed limit, a lift speed limit, etc.), a torque limit, etc. As one example, the modified operation parameter (or operation parameter limit) may include an electric current limit for the lift actuator 675, a drive torque limit for the tractive motor 640, a drive speed limit for the tractive motor 640, an electric current limit for the tractive motor 640, a lift speed limit for the lift actuator 675, or another limit for another electrical actuator of the power machine 600.

In some configurations, at block 825, the electronic processor 700 determines the modified operation parameter for the power machine 600 in response to determining a forward commanded direction of travel, based on the comparison of a relevant orientation to the orientation criterion, or a combination thereof. As one example, the electronic processor 700 may determine the modified operation parameter for the power machine 600 in response to determining that the commanded direction of travel for the power machine 600 is a forward commanded direction of travel (as described in greater detail above) and in response to determining that a relevant orientation satisfies a relevant orientation criterion. As used herein, the term "forward" is used as a term of convenience and, generally, travel can be in any direction in which a lift arm can extend relative to a frame (e.g., travel in the direction of a work element or lift arm).

In some cases, the electronic processor 700 can determine whether a forward tractive movement has been commanded and whether a tilt position satisfies a particular criterion (e.g., as detailed above or below). If these threshold conditions are met, the electronic processor 700 can then control a lift speed limit for a lift actuator based on a position of the lift arm (e.g., as indicated by an amount of extension of a lift actuator). For example, the electronic processor 700 can implement reduction of a lift speed limit based on decreasing lift arm position, including through a linear or other extrapolation between endpoints within a lift position range (e.g., as further discussed relative to FIG. 9, and as can be implemented via a look-up table of linear or non-linear values).

In some cases, further conditions can also (or alternatively) be implemented. For example, a threshold criterion can be used to determine whether or how to modify a particular operation parameter. For example, before imposing a lift speed limit as above (or otherwise), the electronic processor 700 can evaluate whether a tractive motor speed is sufficiently high (e.g., 30% of maximum or more) and, if so, can then determine a modified operation parameter accordingly. For example, the electronic processor 700 may impose a further reduced minimum lift speed limit based on detection of sufficiently high tractive motor speed, including as may result in a relatively slow or stopped movement of a lift arm at a particular lift arm height (e.g., as further discussed relative to FIG. 9).

In some cases, the electronic processor 700 can determine whether a forward tractive movement has been commanded and whether a lift position or a tilt position (or both) satisfy particular respective criterion (e.g., also as detailed above or below). If these threshold conditions are met, the electronic processor 700 can then control a tractive speed or torque limit for a tractive actuator (e.g., the tractive electrical actuator(s) 630) based on a tilt position (e.g., as indicated by an amount of extension of a tilt actuator). For example, the electronic processor 700 can implement reduction of a drive speed or drive torque limit based on increasing tilt arm position, including through a linear or other extrapolation between endpoints within a tilt position range (e.g., as further discussed relative to FIGS. 10 and 11, and as can be implemented via a look-up table of linear or non-linear values.

In some configurations, the electronic processor 700 determines the modified operation parameter for the power machine 600 based on one or more relationships (e.g., direct or indirect functional or other relationships) between two or more operation parameters. In some configurations, the electronic processor 700 determines multiple modified operation parameters for the power machine 600 (e.g., a modified electric current, a modified drive speed, a modified lift speed, a modified drive torque, or a combination thereof).

Figure 9:
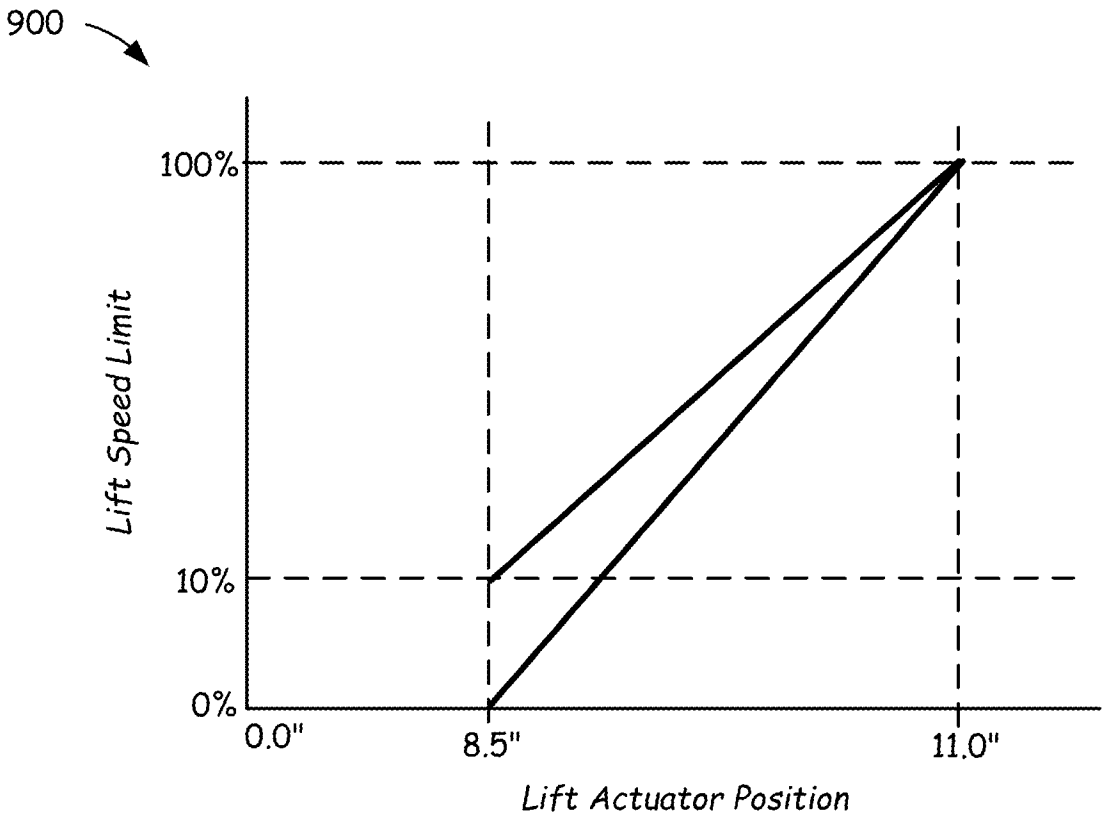
FIG. 9 is a graph illustrating a relationship between lift speed limit and lift actuator position according to some configurations.

FIG. 9 is a graph 900 illustrating a relationship between lift speed and lift position. In particular, the graph 900 illustrates a maximum lift speed limit (i.e., a maximum allowed lift speed) (y-axis) based on a lift actuator position (x-axis). As is illustrated in FIG. 9, the allowed lift speed may have a direct relationship with the lift actuator position, including a linear relationship as shown. Accordingly, in some configurations, the electronic processor 700 may determine the modified operation parameter as a lift speed limit (e.g., a maximum allowed lift speed) based on the modification curves shown on the graph 900. As one example, the electronic processor 700 may determine the lift speed limit based on the lift actuator position.

In some cases, a lift speed limit can be reduced to zero at a non-zero lift height, depending on particular operational conditions. For example, if a present speed of a tractive motor is sufficiently high (e.g., greater than 30% of a maximum possible speed), a controller can reduce a maximum lift speed limit to zero at a non-zero lift height. Thus, for example, when a power machine may be traveling at relatively high speeds, a controller can not only slow movement of a lift arm as the lift arm is lowered, but also stop downward movement of the lift arm at an elevated position (e.g., 8.5 inches as shown).

Figure 10:
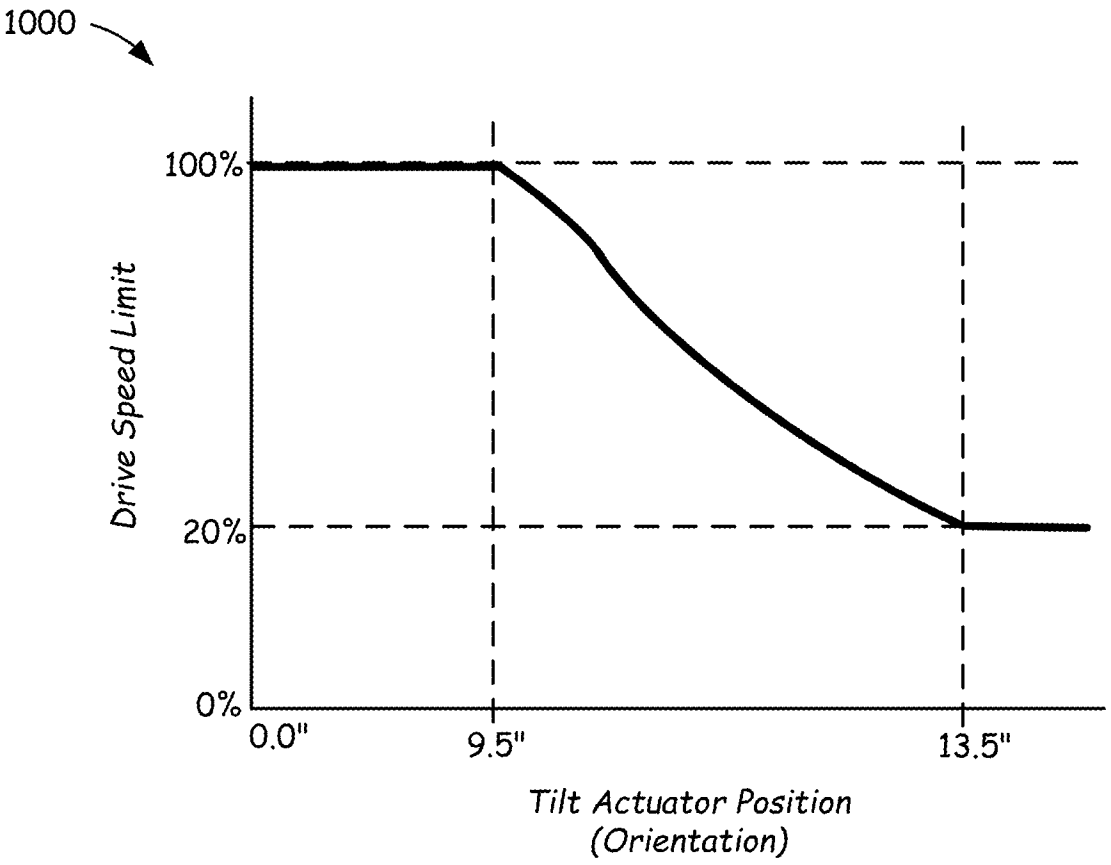
FIG. 10 is a graph illustrating a relationship between drive speed limit and orientation according to some configurations.

FIG. 10 is a graph 1000 illustrating a relationship between drive speed and tilt position (e.g., with respect to the tractive motor 640 and the tilt actuator 680, respectively). In particular, the graph 1000 illustrates a maximum drive speed limit (i.e., a maximum allowed drive speed) (y-axis) based on a tilt actuator position (x-axis). As is illustrated in FIG. 10, the allowed drive speed may have an indirect relationship with the tilt actuator position, including a generally linear indirect relationship as shown. Accordingly, in some configurations, the electronic processor 700 may determine the modified operation parameter as an allowed drive speed (e.g., a drive speed limit) based on the graph 1000. As one example, the electronic processor 700 may determine the drive speed limit based on the tilt actuator position.

Figure 11:
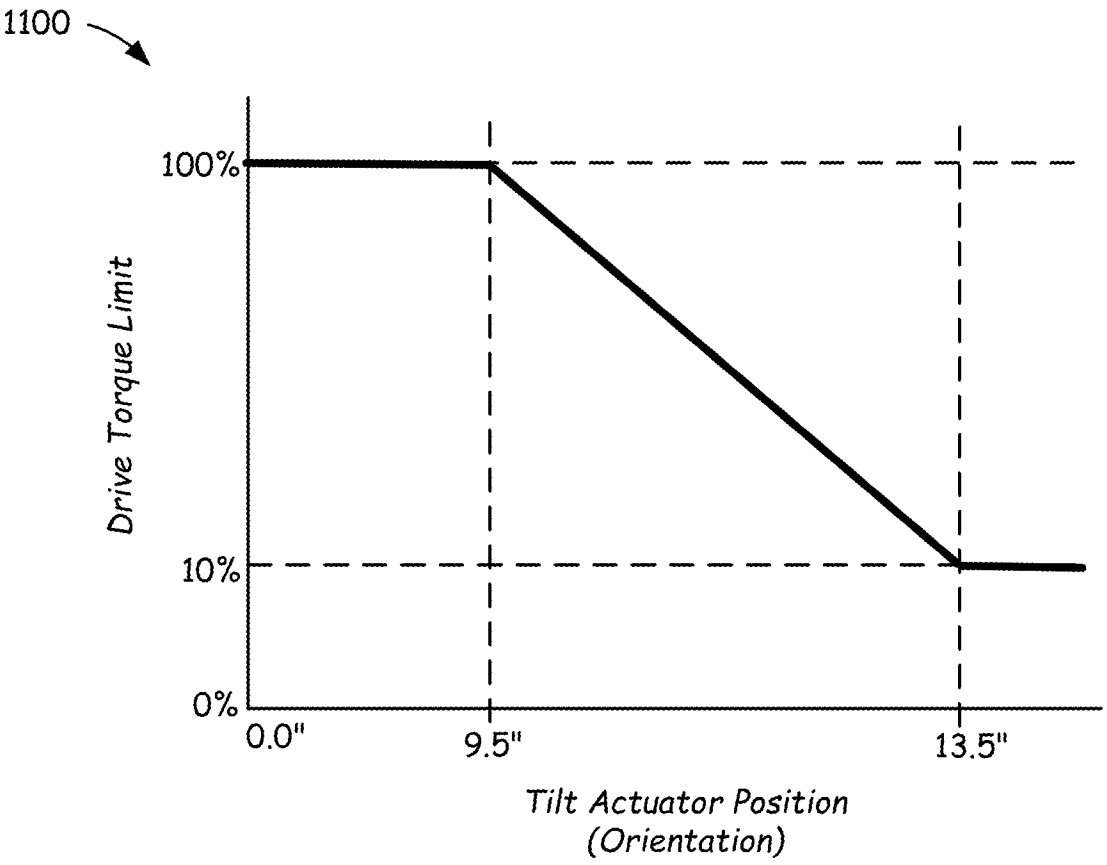
FIG. 11 is a graph illustrating a relationship between drive torque limit and orientation according to some configurations.

FIG. 11 is a graph 1100 illustrating a relationship between drive torque and tilt position (e.g., with respect to the tractive motor 640 and the tilt actuator 680, respectively). In particular, the graph 1100 illustrates an allowed drive torque (y-axis) based on a tilt actuator position (x-axis). As is illustrated in FIG. 11, the allowed drive torque may have an indirect relationship with the tilt actuator position, including a linear indirect relationship as shown. Accordingly, in some configurations, the electronic processor 700 may determine the modified operation parameter as an allowed drive torque (e.g., a drive torque limit) based on the graph 1100. As one example, the electronic processor 700 may determine the drive torque limit based on the tilt actuator position.

As also noted above, a reduction in a lift speed limit can sometimes be implemented only after a lift arm has been appropriately lowered. For example, as shown in FIG. 9, a reduced lift speed limit can be applied when a lift actuator is at about 45% of maximum extension, or about 11 inches of extension. Similarly, FIG. 9 illustrates an example lower bound to a lift actuator range for lift speed limit reductions, corresponding in the illustrated example to about 30% of maximum extension of a lift actuator, or about 8.5 inches of extension. Similarly, some criteria can relate to height of a work element relative to a reference height. For example, a reduced lift speed limit (or other adjustment) can be implemented based on whether a lift position of a lift arm, as measured at a reference location (e.g., an implement pivot point), is more or less than a predetermined height about a ground surface.

In some configurations, the electronic processor 700 determines the modified operation parameter by performing a look-up function with respect to one of the graphs illustrated in FIGS. 9-11. As one example, the electronic processor 700 may determine a modified lift speed as the value of a y-axis data point included in the graph 900 corresponding to a current lift actuator position (x-axis data point). As another example, the electronic processor 700 may determine a modified drive speed as the value of a y-axis data point included in the graph 1000 corresponding to a current tilt actuator position (x-axis data point). As yet another example, the electronic processor 700 may determine a modified drive torque as the value of a y-axis data point included in the graph 1100 corresponding to a current tilt actuator position (x-axis data point).

As noted above, in some configurations, the electronic processor 700 may determine a modified operation parameter (or operation parameter limit) as a modified electric current (or electric current limit).

Figure 12:
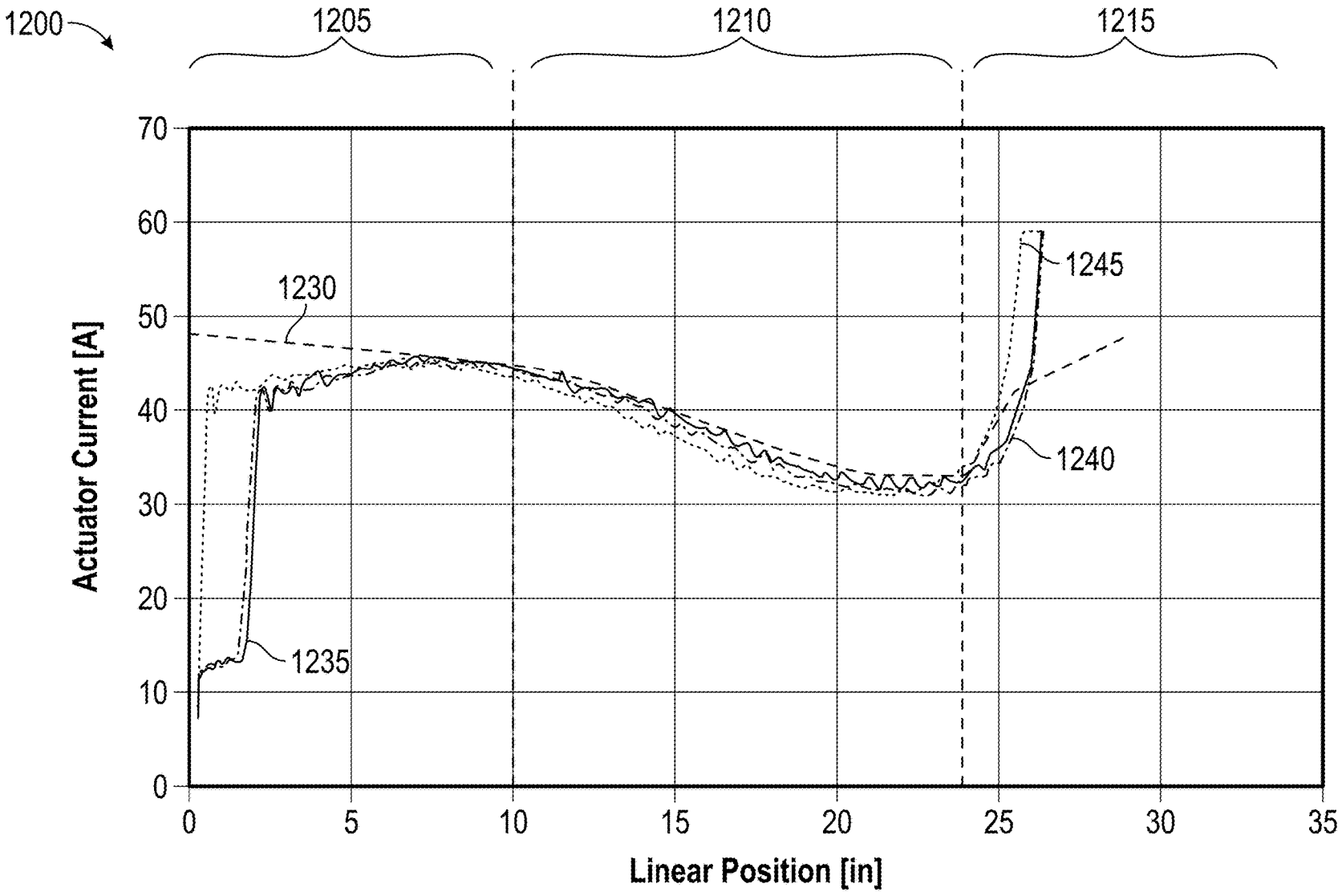
FIG. 12 is a graph illustrating a relationship between actuator current and lift position according to some configurations.

FIG. 12 is a graph 1200 illustrating a relationship between actuator electric current (y-axis) and lift position (x-axis) with respect to the lift actuator 675 according to some configurations. As illustrated in FIG. 12, the graph 1200 includes three lift position ranges: a break-out range 1205, a discrete central range 1210, and a full-extension range 1215.

The lift positions of the break-out range 1205 may be associated with performance of a break-out operation or maneuver. The electronic processor 700 may detect a break-out condition based on the lift position and a break-out condition criterion (e.g., as one of the control criteria 750). The break-out condition criterion may include criterion that indicate a set of conditions that are indicative of a break-out condition. As one example, a condition indicative of a break-out condition may be a lift operation being performed at low lift positions (e.g., as indicated by the break-out range 1205 in FIG. 12). In other words, a break-out condition criterion may correspond to lift positions within a break-out range. In response to detecting the break-out condition, the electronic processor 700 may determine an electric current limit based on a comparison of the lift position to the break-out condition criterion.

The lift positions of the central range 1210 may be associated with performance of a lift operation or maneuver at normal lift positions. The lift positions of the full-extension range 1215 may be associated with performance of a lift operation or maneuver over high lift positions, and, e.g., lift operations involved with fully extending the lift actuator 675.

As illustrated in FIG. 12, the graph 1200 also includes an electric current limit line 1230. The electrical current limit line 1230 represents an electric current limit associated with each lift position. In some configurations, the electronic processor 700 may determine the electric current limit based on a current linear lift position of the lift actuator 675 using the electric current limit line 1230 of the graph 1200. For instance, the electric current limit within the break-out range 1205 may be for performing a break-out operation with the power machine 600. The electric current limit within the central range 1210 is associated with performing a lift operation with the power machine 600. As illustrated in FIG. 12, the electric current limits associated with the break-out range 1205 are different from the electric current limits associated with the central range 1210. The electric current limits within the full-extension range 1215 are associated with performing a full-extension operation or maneuver with the power machine 600. As illustrated in FIG. 12, the electric current limits associated with the full-extension range 1215 are different from the electric current limits associated with the break-out range 1205 and the electric current limits associated with the central range 1210.

As illustrated in FIG. 12, the electric current limits associated with the break-out range 1205 generally represent increased electric current, and the electric current limits associated with the full-extension range 1215 generally represent decreased electric current, as compared to current limits of the adjacent central range 1210. For instance, the electric current limit corresponds to a dynamically increased load rating when the lift position is within the break-out range 1205 of lift positions, where lift positions of the break-out range 1205 are lower than lift positions of the central range 1210.

In some configurations, the electric current limit may correspond to a load rating implemented for the lift arm of the power machine 600. In this regard, the electric current limit line 1230 can correspond to a substantially constant load rating for an example lift arm over the central range 1210 (i.e., a load rating that varies by less than 5%), as also indicated by the traces of actual electric current draw for the load rating along the plots for Actuator 3-1 (represented in FIG. 12 by reference numeral 1235), Actuator 4-1 (represented in FIG. 12 by reference numeral 1240), and Actuator 3-2 (represented in FIG. 12 by reference numeral 1245). In contrast, as can also be seen by comparison the traces of actual electric current draw, the electric current limit line 1230 can correspond to an increased load rating in the break-out range 1205, as can allow for more reliable performance of a power machine with a lift arm at low lift heights. Further, as similarly shown by comparison with the traces of actual electric current draw, the electric current limit line 1230 can correspond to a reduced load rating in the full-extension range 1215, as can allow for more secure operations at high lift heights and lowered risk of excess electric current draw at a lift actuator.

Figure 13:
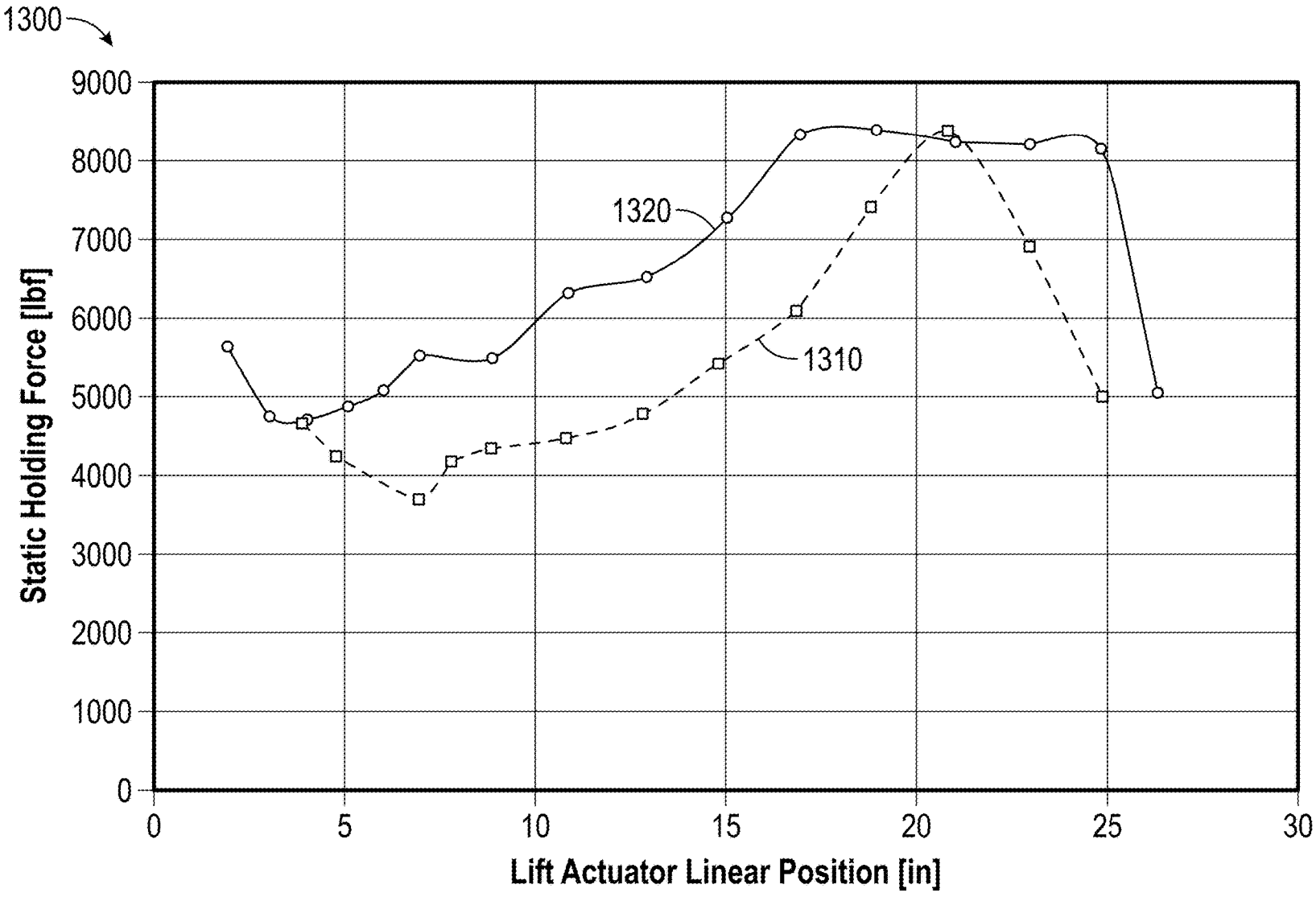
FIG. 13 is a graph illustrating a relationship between static holding force and lift actuator linear position according to some configurations.

In some cases, such an arrangement can be tailored to correspond to the loading characteristics of a particular lift arm. For example, the electric current limit line 1230 as illustrated in FIG. 12 can correspond in particular to a lift arm that exhibits static holding characteristics as illustrated in FIG. 13. In particular, FIG. 13 is a graph 1300 illustrating a relationship between static holding force (y-axis) and lift actuator linear position (x-axis) according to some configurations. As illustrated in FIG. 13, the graph 1300 includes a first plot 1310 for a first power machine and a second plot 1320 for a second power machine, where the first plot 1310 represents a relationship between static holding force and lift actuator linear position for the first power machine and the second plot 1320 represents a relationship between static holding force and lift actuator linear position for the second power machine. As illustrated in FIGS. 12-13, when the lift position is within the break-out range 1205, the electric current limit can be dynamically increased to provide improved performance at lower lift positions. As further illustrated in FIGS. 12-13, when the lift position is within the full-extension range 1215, the electric current limit can be dynamically decreased so as to avoid excessive electric current without a risk of underperformance at high lift heights. Accordingly, in some configurations, the electronic processor 700 may determine the modified operation parameter as an electric current limit based on the graphs of FIGS. 12-13.

Returning again to FIG. 8, the electronic processor 700 may control the power machine 600 using the modified operation parameter (at block 830). The electronic processor 700 may control the power machine 600 using the modified operation parameter by controlling one or more electrical actuators associated with the modified operation parameter, such as the tractive motor 640, the lift actuator 675, or the like. Accordingly, in some configurations, the electronic processor 700 controls the power machine 600 by imposing an operation parameter limit (as the modified operation parameter) such that a corresponding operation parameter is limited based on the operation parameter limit.

As one example, when the modified operation parameter is a drive torque limit, the electronic processor 700 may control the tractive motor 640 such that a drive torque of the tractive motor 640 complies with the modified operation parameter (e.g., the drive torque limit). As another example, when the modified operation parameter is a drive speed limit, the electronic processor 700 may control the tractive motor 640 such that a drive speed of the tractive motor 640 complies with the modified operation parameter (e.g., the drive speed limit). As yet another example, when the modified operation parameter is a lift speed limit, the electronic processor 700 may control the lift actuator 675 such that a lift speed of the lift actuator 675 complies with the modified operation parameter (e.g., the lift speed limit).

In some embodiments, aspects of the disclosed technology, including computerized implementations of methods according to the disclosed technology, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the disclosed technology can be implemented as a set of instructions, tangibly embodied on a non-transitory computer-readable media, such that a processor device can implement the instructions based upon reading the instructions from the computer-readable media. Some embodiments of the disclosed technology can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.).

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the disclosed technology, or of systems executing those methods, may be represented schematically in the FIGs. or otherwise discussed herein. Unless otherwise specified or limited, representation in the FIGs. of particular operations in particular spatial order may not necessarily require those operations to be executed in a particular sequence corresponding to the particular spatial order. Correspondingly, certain operations represented in the FIGs., or otherwise disclosed herein, can be executed in different orders than are expressly illustrated or described, as appropriate for particular embodiments of the disclosed technology. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." Further, a list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of each of A, B, and C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C. In general, the term "or" as used herein only indicates exclusive alternatives (e.g. "one or the other but not both") when preceded by terms of exclusivity, such as "either," "one of," "only one of," or "exactly one of."

Also as used herein, unless otherwise specified or limited, the terms "about" and "approximately" as used herein with respect to a reference value refer to variations from the reference value of ±20% or less (e.g., ±15, ±10%, ±5%, etc.), inclusive of the endpoints of the range. Similarly, as used herein with respect to a reference value, the term "substantially equal" (and the like) refers to variations from the reference value of less than ±5% (e.g., ±2%, ±1%, ±0.5%) inclusive. Where specified in particular, "substantially" can indicate a variation in one numerical direction relative to a reference value. For example, the term "substantially less" than a reference value (and the like) indicates a value that is reduced from the reference value by 30% or more (e.g., 35%, 40%, 50%, 65%, 80%), and the term "substantially more" than a reference value (and the like) indicates a value that is increased from the reference value by 30% or more (e.g., 35%, 40%, 50%, 65%, 80%).

Also as used herein, unless otherwise limited or defined, "current" is generally used as a temporal measure, i.e., to indicate a present value (e.g., a present position, load, lift position, etc.). In contrast, "electric current" is used to refer to the flow of electric charge in electric systems.

Although the present invention has been described by referring to preferred embodiments, workers skilled in the art will recognize that changes may be made in form and detail without departing from the scope of the discussion.

What is claimed is:

1. An electric power machine, the electric power machine comprising:

a power machine frame;

a plurality of electrical actuators supported by the power machine frame, wherein the plurality of electrical actuators includes a tractive motor, a lift actuator, and a tilt actuator;

a lift arm structure that includes:

a lift arm coupled to the power machine frame and configured to be moved relative to the power machine frame by the lift actuator; and a work element supported by the lift arm and configured to be moved relative to the lift arm by the tilt actuator;

an electrical power source configured to power the plurality of electrical actuators; and one or more electronic processors in communication with the plurality of electrical actuators, the one or more electronic processors configured to:

receive operation data for a current operation of the electric power machine, determine, based on the operation data, a commanded direction of travel for the electric power machine, determine, based on the operation data, an orientation of the work element relative to the lift arm, compare the orientation to an orientation criterion, and in response to determining the commanded direction of travel is for a first direction of travel and based on the comparison, determine a modified operation parameter for the electric power machine, and control the at least one of electrical actuators based on the modified operation parameter.

2. The electric power machine of claim 1, wherein the first direction of travel is a forward direction of travel; and wherein the one or more electronic processors are configured to:

determine the commanded direction of travel for the electric power machine by detecting a commanded speed, and determine that the commanded direction of travel for the electric power machine for the forward direction of travel based on the commanded speed being a positive speed value that exceeds a preset positive speed value.

3. The electric power machine of claim 1, wherein the modified operation parameter corresponds to a reduced power or speed for one or more of the tractive motor or the lift actuator, in response to a given command input.

4. The electric power machine of claim 3, wherein the orientation includes a tilt position and the orientation criterion includes a tilt criterion;

wherein the one or more electronic processors are further configured to determine, based on the comparison, whether the tilt position satisfies the tilt criterion; and wherein the tilt position satisfies the tilt criterion when the tilt position is within a predetermined extension range.

5. The electric power machine of claim 1, wherein the orientation includes a lift position of the lift arm and the orientation criterion includes a lift position criterion; and wherein the one or more electronic processors are further configured to:

compare the lift position of the lift arm to the lift position criterion, and determine the modified operation parameter based on the comparison of the lift position to the lift position criterion.

6. The electric power machine of claim 5, wherein the one or more electronic processors are configured to determine the modified operation parameter in response to determining that the lift position of the lift arm is less than a predetermined distance above a reference height.

7. The electric power machine of claim 6, wherein the reference height corresponds to a ground surface.

8. The electric power machine of claim 1, wherein the orientation includes a lift position of the lift arm and the orientation criterion includes a lift position criterion; and wherein the modified operation parameter defines a linear or other reduction in a maximum speed of the lift actuator in response to a lowering of the lift position.

9. The electric power machine of claim 8, wherein the one or more electronic processors are further configured to:

determine a travel speed of the electric power machine, compare the travel speed of the electric power machine to a travel speed criterion, and in response to the travel speed of the electric power machine satisfying the travel speed criterion, limiting a lift speed to zero for a non-zero lift height.

10. The electric power machine of claim 1, wherein the orientation includes a tilt position and the orientation criterion includes a tilt criterion; and wherein the modified operating parameter is a speed limit for the lift actuator.

11. The electric power machine of claim 1, wherein the orientation includes a tilt position and the orientation criterion includes a tilt criterion; and wherein the modified operating parameter is a speed limit for the tractive motor that defines a linear or other reduction in maximum drive speed in response to an extending of the tilt position.

12. The electric power machine of claim 1, wherein the orientation includes a tilt position and the orientation criterion includes a tilt criterion; and wherein the modified operating parameter is a drive torque limit for the tractive motor that defines a linear or other reduction in a tractive torque in response to an extending of a lift position.

13. An electric power machine, the electric power machine comprising:

a power machine frame;

a plurality of electrical actuators supported by the power machine frame, wherein the plurality of electrical actuators includes a tractive motor, a lift actuator, and a tilt actuator;

a lift arm structure that includes:

a lift arm coupled to the power machine frame and configured to be moved relative to the power machine frame by the lift actuator; and a work element supported by the lift arm and configured to be moved relative to the lift arm by the tilt actuator;

an electrical power source configured to power the plurality of electrical actuators; and one or more electronic processors in communication with the plurality of electrical actuators, the one or more electronic processors configured to:

receive operation data for a current operation of the electric power machine, determine, based on the operation data, a commanded direction of travel for the electric power machine, determine, based on the operation data, an orientation of the work element relative to the lift arm, perform a comparison of the orientation to an orientation criterion, and in response to determining the commanded direction of travel is for a first direction of travel and based on the comparison, determine an operational limit for the tractive motor, and control the tractive motor based on the operational limit.

14. The electric power machine of claim 13, wherein the operational limit for the tractive motor is a drive torque limit, and wherein the one or more electronic processors control the tractive motor based on the drive torque limit.

15. The electric power machine of claim 13, wherein the operational limit for the tractive motor is a drive speed limit, and wherein the one or more electronic processors control the tractive motor based on the drive speed limit.

16. A method of operating an electric power machine, the method comprising:

receiving, with one or more electronic processors, input parameters corresponding to one or more of: an operator input for operating the electric power machine or sensed operation data for the electric power machine;

determining, with the one or more electronic processors, a first direction of a commanded direction of travel for the electric power machine based on one or more of the input parameters;

determining, with the one or more electronic processors, an orientation of a work element of the electric power machine based on one or more of the input parameters;

perform a first comparison of the orientation to an orientation criterion;

determining, with the one or more electronic processors, a lift position of a lift arm of the electric power machine, and performing, with the one or more electronic processors, a second comparison of the lift position to a lift criterion; and for travel in the determined first direction, and based on the first and second comparisons:

determining, with the one or more electronic processors, an operational limit for an electrical actuator of the electric power machine that includes a drive actuator or a lift actuator, and controlling, with the one or more electronic processors, the electrical actuator of the electric power machine based on the operational limit.

17. The method of claim 16, wherein determining the operational limit for the electrical actuator of the electric power machine includes determining a speed limit for the lift actuator of the electric power machine, and wherein controlling the electrical actuator of the electric power machine includes controlling the lift actuator based on the speed limit.

18. The method of claim 17, wherein the speed limit for the lift actuator is determined based on a present lift position of the lift actuator.

19. The method of claim 16, wherein the drive actuator is a tractive motor, and wherein determining the operational limit for the electrical actuator of the electric power machine includes determining a drive torque limit for the tractive motor of the electric power machine, wherein controlling the electrical actuator of the electric power machine includes controlling the tractive motor based on the drive torque limit.

20. The method of claim 19, wherein the drive torque limit for the tractive motor is determined based on a present tilt position of the work element, according to a direct relationship between drive torque limit and tilt position of the work element.

* * * * *